US011078719B2

(12) United States Patent
Donohue

(10) Patent No.: US 11,078,719 B2
(45) Date of Patent: Aug. 3, 2021

(54) INDEPENDENTLY OPERATING INSULATED GLASS UNIT ASSEMBLY LINE AND METHOD

(71) Applicant: Erdman Automation Corporation, Princeton, MN (US)

(72) Inventor: Morgan Donohue, Mendota Heights, MN (US)

(73) Assignee: Erdman Automation Corporation, Princeton, MN (US)

( * ) Notice: Subject to any disclaimer, the term of this patent is extended or adjusted under 35 U.S.C. 154(b) by 269 days.

(21) Appl. No.: 16/120,763

(22) Filed: Sep. 4, 2018

(65) Prior Publication Data

US 2019/0071921 A1 Mar. 7, 2019

Related U.S. Application Data

(60) Provisional application No. 62/554,293, filed on Sep. 5, 2017.

(51) Int. Cl.

| | |
|---|---|
| ***E06B 3/673*** | (2006.01) |
| ***E06B 3/677*** | (2006.01) |
| ***E06B 3/663*** | (2006.01) |

(52) U.S. Cl.

CPC ..... *E06B 3/67326* (2013.01); *E06B 3/663* (2013.01); *E06B 3/6733* (2013.01); *E06B 3/6775* (2013.01); *E06B 3/67347* (2013.01); *E06B 3/67365* (2013.01); *E06B 3/67369* (2013.01); *E06B 3/67382* (2013.01)

(58) Field of Classification Search

CPC ..... E06B 3/67326; E06B 3/67382; E06B 3/6733; E06B 3/67369; E06B 3/67347; E06B 3/6775; E06B 3/67365; E06B 3/663

See application file for complete search history.

(56) References Cited

U.S. PATENT DOCUMENTS

| | | | | |
|---|---|---|---|---|
| 5,173,148 | A * | 12/1992 | Lisec | B65G 49/061 156/356 |
| 5,803,943 | A | 8/1998 | Parson | |
| 5,823,732 | A | 10/1998 | Lisec | |
| 6,158,483 | A | 12/2000 | Trpkovski | |
| 6,378,586 | B1 | 4/2002 | Lafond | |
| 6,494,245 | B1 | 12/2002 | Simone | |
| 6,553,653 | B2 | 4/2003 | Hulings | |
| 6,793,971 | B2 | 9/2004 | Trpkovski | |
| 8,910,453 | B2 | 12/2014 | Jones | |
| 9,004,262 | B2 | 4/2015 | Mader | |
| 9,656,356 | B2 | 5/2017 | Pemberton | |
| 9,951,553 | B2 | 4/2018 | Donohue | |
| 2003/0059532 | A1 | 3/2003 | Vianello | |
| 2003/0146066 | A1 | 8/2003 | Ashton | |
| 2005/0013950 | A1 | 1/2005 | Trpkovski | |
| 2009/0311449 | A1 | 12/2009 | Fehlmann | |
| 2011/0154635 | A1 | 6/2011 | Wunnicke | |
| 2013/0061978 | A1 | 3/2013 | Donohue | |
| 2014/0083026 | A1* | 3/2014 | Grommesh | E06B 3/66304 52/171.3 |

(Continued)

*Primary Examiner* — Jacob T Minskey
*Assistant Examiner* — S. Behrooz Ghorishi
(74) *Attorney, Agent, or Firm* — Patterson Thuente Pedersen, P.A.

(57) ABSTRACT

An insulated glass assembly line generally includes a first and second automated lite picker, a washer, a vertical gas filling and wetting station, a robot, and an applicator station.

20 Claims, 20 Drawing Sheets

(56) References Cited

U.S. PATENT DOCUMENTS

| | | | | |
|---|---|---|---|---|
| 2014/0352841 | A1 | 12/2014 | Zurn | |
| 2015/0259970 | A1 | 9/2015 | Briese | |
| 2015/0354266 | A1* | 12/2015 | Donohue | C03C 27/10 156/559 |
| 2016/0298376 | A1 | 10/2016 | Queck | |
| 2017/0074032 | A1 | 3/2017 | Briese | |
| 2017/0306690 | A1 | 10/2017 | Donohue | |
| 2018/0087313 | A1 | 3/2018 | Donohue | |
| 2018/0230735 | A1 | 8/2018 | Donohue | |

* cited by examiner

INDEPENDENTLY OPERATING INSULATED GLASS UNIT ASSEMBLY LINE AND METHOD

CROSS-REFERENCE TO RELATED APPLICATION

This application claims the benefit of U.S. Provisional Application No. 62/554,293, filed Sep. 5, 2017, entitled "Independently Operating Insulated Glass Unit Assembly Line and Method," which is hereby incorporated herein in its entirety by reference.

TECHNICAL FIELD

This invention relates to the automated assembly of insulated glass units.

BACKGROUND

Insulated glass generally includes at least two panes of similarly shaped glass, called lites, separated from one another by a perimeter spacer. Building codes in many areas of the country require insulated glass installation as an energy conservation measure, particularly for large commercial properties, because insulated glass units (IGUs) have much greater insulating value than a single pane of glass alone.

A primary sealant binds the two lites to the spacer, preventing ambient air movement into the space between the glass panes. The spacer in an IGU is inset from the peripheral edges, creating a trough-shaped space around the IGU's perimeter. Two sides of the trough are defined by the two lites, and the third is defined by the spacer. A gas such as argon, xenon, or krypton fills the interior space between the lites. Filling the interior space with a gas that is denser than air markedly increases the IGU's energy efficiency and helps prevent condensation from forming on the IGU's interior surfaces. A secondary sealant fills the trough-shaped space around the IGU's perimeter to further improve the IGU's energy efficiency.

In high-volume manufacturing facilities, fully automated equipment commonly applies the spacer and the secondary sealant to the IGU. Fully automated equipment of this sort can manufacture large numbers of identically shaped IGUs. Using automated equipment can therefore help manufacturers reduce costs and increase output; however, the automated manufacturing process requires many different processing units that, occupy substantial physical space and require relatively long periods of time per production run.

FIG. 1 is a process flow diagram representative of automated manufacturing processes typical in the prior art. As shown, nine processing stations are required to produce a single IGU. Typically, these processing stations orient the lites horizontally as they move along the production line. Horizontal orientation helps prevent the large pieces of glass from warping or breaking, but maximizes the amount of floor space occupied by the lites and equipment.

In the example depicted in FIG. 1, the lites are placed on a conveyor or assembly line at an in-feed station. The conveyor then moves each lite into a washer station that cleans both surfaces of the glass. Clean surfaces are important to ensure that the primary and secondary sealants adhere to the glass and because the interior surfaces will be inaccessible once the IGU is complete, making any visible dirt impossible to remove. Accordingly, an inspection station generally follows the washer station to ensure that the panes have been adequately cleaned.

Prior art often refers to the lites as pairs comprising a spacer lite and a wetting or topping lite. The spacer lite is the lite to which the peripheral spacer is applied. The wetting lite is the lite that will be placed across from the spacer lite during the wetting process, generally by positioning the wetting lite on top of the spacer lite. The spacer lite typically requires more processing time and work than the wetting lite, because the spacer must be applied before the wetting process, so the spacer lite is conveyed to each processing station first. A second pane of glass that will become the wetting lite typically follows the first lite in tandem fashion.

In the example depicted in FIG. 1, the first lite is conveyed from the inspection station to the spacer application station. According to some prior art examples, the second lite can be directed along an alternative assembly line after exiting the washer as the first lite is directed along a primary assembly line and mated with the spacer. An example of this is disclosed in U.S. Pat. No. 9,951,553. Primary sealant binds the spacer to the first lite at the spacer application station. Prior art examples disclose fully automated spacer application stations that can apply the primary sealant and the spacer simultaneously.

Typically, the first lite must be queued at an out-feed station while the second lite is prepared for the gas filling and wetting processes. Once the second lite is prepared, the two lites are aligned with one another across the spacer. At the gas filling and wetting station, the cavity between the lites and within the spacer is typically filled with gas before the two lites are pressed together and sealed with the primary sealant. The spacer material is typically pre-coated with the primary sealant, which binds the second lite to the spacer and the first lite via the pressure applied when the lites are pressed together. During the gas filling process, a dense, non-air gas is injected into the cavity, forcing ambient air and moisture out from between the panes. In some examples, like the depicted in FIG. 1, a single, fully automated station can perform both the wetting and the gas filling processes. Other prior art examples require separate processing stations for the wetting and gas filling processes. These insulated glass assembly lines are typically lengthy and may include, for example, up to 15 processing stations totaling a length of approximately 165 feet.

The IGU is typically conveyed next to an out-feed station that can also serve as an inspection station where an employee ensures the two lites are properly bonded together. Then the IGU is conveyed to the secondary sealant application station, where secondary sealant is applied to the trough-shaped space surrounding the IGU's peripheral edges. Finally, the IGU is conveyed to a final out-feed station, from which the IGU may be removed for storage and/or delivery.

Some prior art examples describe processes that adjust the lites from a horizontal orientation to a vertical orientation during the wetting and gas filling processes, reducing the physical space those processing stations occupy. Floor space is a particular concern when manufacturing IGUs for commercial properties, which often use very large panes of glass. Some prior art examples also describe processes that utilize separate assembly lines for the first and second lite, so that the spacer can be applied to the first lite while the second lite is prepared for the gas filling and wetting processes. The first lite and second lite still require different preparation times, however, so these processes still require extra space and production run time to queue at least one of the lites until both pieces of glass are ready to be sealed together. Thus, there is a need in the window manufacturing industry for an insulated glass assembly process that reduces the space, time, and labor of IGU manufacture.

SUMMARY

An insulated glass unit assembly line, according to example embodiments of the invention, reduces the amount of space, time, and labor required to manufacture IGUs. According to an example embodiment of the invention, the assembly line enables the automated IGU assembly from multiple lites that are aligned across a spacer, bound together with a primary sealant, filled with gas, and peripherally sealed by a secondary sealant. Embodiments of the invention are expected to reduce the manufacturing process's physical space requirements by more than 50% and reduce the manual labor required from approximately five workers to about one half worker required to support operation of the production line. Embodiments of the invention are additionally expected to reduce the cycle time required to load lites and spacer and unload completed insulated glass units, further reducing manufacturing costs. An example embodiment of the assembly line generally includes an automated lite picker, a washer, a vertical gas filling and wetting station, a robot, an applicator station, and an IGU storage rack.

The automated lite picker, according to an example embodiment of the invention, generally includes a ground engaging support, a vertical conveyor, a picker arm, and a lite storage rack. The automated lite picker is typically the first processing unit of the assembly line, and may be oriented such that the vertical conveyor is parallel to the travel axis of the assembly line.

According to another example embodiment of the invention the lite picker may also take the form of a robot, for example, a six axis robot. The application of such a robot enables greater flexibility in the lite loading and placement process. The lite picker robot may be located in front of or behind the lite picker conveyor depending upon a manufacturer's preference as to which side of the completed insulated glass unit the lite with low-E coating is to be located on during the manufacturing process. In the case of the lite picker robot being located behind the lite picker conveyor the lite picker conveyor may include an open portion of the vertical light support that permits the robot to reach through the lite picker conveyor to reach the lites. In this case the robot may include a glass gripper as well as roller beams supported adjacent to the glass gripper.

The ground engaging support, in an example embodiment of the invention, generally comprises parallel beams or rails that stabilize the vertical conveyor. For example, the ground engaging support may comprise two parallel rails that are resting on the ground, parallel to the travel axis of the assembly line, behind the vertical conveyor. In this context, the travel axis of the assembly line is the direction that is parallel to the axis along which the lites generally travel as they move through the assembly line from one processing station to the next processing station. The ground engaging support may also comprise other stabilization structures, including rails that are oriented in other directions, for example, perpendicular to the travel axis of the conveyor.

The vertical conveyor, according to an example embodiment, generally includes a support platform and a conveyor. The vertical conveyor may be mounted, for example, on top of the ground engaging support rails.

The support platform, according to an example embodiment of the invention, generally comprises support frames mounted to the ground engaging support above the conveyor. According to an example embodiment of the invention, the support frames comprise two co-planar rectangular structures separated by a gap through which the extension arm assembly of the picker arm can extend and retract perpendicularly to the conveyor. The support platform may hold the lites in a substantially vertical orientation as the lites are conveyed along the assembly line by the conveyor. Substantially vertical, in this context, means that the lites are held at an orientation that is less than about 25 degrees of true vertical. More typically, the lites are held within 6 to 10 degrees of true vertical, for example, at 6 degrees of true vertical.

According to an example embodiment of the invention, the support platform further includes roller beams coupled to the support frames such that the gap between the support frames is maintained. The roller beams generally comprise multiple parallel rows of passive wheels or rollers over which the lite safely travels under the impetus of the conveyor. For example, the roller beams may be comprised of caster wheels or ball bearings.

The conveyor, according to an example embodiment of the invention, generally moves the lites, in tandem fashion, along the travel axis of the assembly line. According to an example embodiment of the invention, the conveyor can extend along the bottom edge of the support platform.

The picker arm, according to an example embodiment of the invention, generally comprises a picker arm vertical support column and an extension arm assembly.

The picker arm vertical support column, according to an example embodiment of the invention, generally includes a vertical column perpendicularly mounted on the ground engaging support. For example, the picker arm vertical support column may be located on the opposite side of the support platform from the conveyor. Alternatively, the picker arm vertical support column may rest on the ground, suspended from an overhead support, such as tracks, rest on a platform, or otherwise not mounted on the ground engaging support. The extension arm assembly, according to an example embodiment of the invention, generally includes an extension arm track, an extension arm slide, and a glass-gripper head.

The extension arm track, according to an example embodiment of the invention, generally comprises a track that is perpendicularly coupled to the picker arm vertical support column and that operates in a similar fashion to the stabilized track portion of a drawer. For example, the extension arm track may be coupled to the picker arm vertical support column above the ground engaging support and aligned with the gap between the support frames. In one embodiment of the invention, the extension arm track may be fixedly coupled to the picker arm vertical support column. In alternative embodiments, the extension arm track may include a vertically modifiable coupling to the picker arm vertical support column, permitting adjustment of the extension arm track's height to accommodate the manufacture of different sizes and/or shapes of IGUs.

The extension arm slide, according to an example embodiment of the invention, generally comprises a slide inserted into the extension arm track that operates in a similar fashion to the movable slide portion of a drawer. In an example embodiment of the invention, the extension arm slide can extend and retract along the extension arm track, perpendicular to and above the conveyor, between the support frames of the support platform.

The glass-gripper head, according to an example embodiment of the invention, is attached to the extension arm slide such that the glass-gripper head can reach the lite storage rack when the extension arm assembly is extended. The glass-gripper head is capable of gripping the lite and supporting the lite's weight as the picker arm transports the lite from the lite storage rack to the vertical conveyor. For example, the glass-gripper head may utilize a plurality of suction grippers to grip a lite as the extension arm assembly retracts from the lite storage rack to the vertical conveyor. Additionally, when the extension arm assembly is fully retracted the glass-gripper head may release the grip on the lite, and then rest in a position that is out of the direct path of the movement of the lite along the assembly line. For example, the glass-gripper head may have a resting position that is slightly behind the support platform.

The lite storage rack, according to an example embodiment of the invention, stores the lites in a substantially vertical orientation before they are placed on the vertical conveyor. In an example embodiment of the invention, the lite storage rack is situated approximately parallel to and in front of the travel axis of the conveyor, such that the stored lites are facing the assembly line and may be reached by the picker arm when it is extended.

In alternative embodiments, the assembly line may include multiple automated lite pickers and lite storage racks. For example, the assembly line may include a first automated lite picker and a second automated lite picker. Both the first automated lite picker and the second automated lite picker may have a substantially similar structure to the automated lite picker previously described. Generally, using two automated lite pickers and two lite storage racks permits the assembly line to manufacture IGUs from lites that have been pre-treated with a coating. Additional automated lite pickers and lite storage racks may also be included, for example to facilitate manufacture of IGUs from more than two lites.

The lites may comprise glass panes that have been pre-treated in some way, such as with a low emissivity coating like a silver-based film. Low emissivity coatings are generally added to lites to facilitate the IGU's thermal efficiency. According to an example embodiment, the first automated lite picker may be paired with a first lite storage rack having lites oriented such that the coating is on the back side of the lite. Back side, in this context, means that the coating is on the side of the lite that is facing the vertical conveyor. The second automated lite picker, according to this example embodiment, may be paired with a second lite storage rack that has the lites oriented such that the coating is on the front side of the lite. Front side, in this context, means that the coating is on the side of the lite that is facing away from the vertical conveyor.

In an embodiment comprising a robot lite picker, the robot lite picker may be located either in front of or behind the conveyor. In the event that the robot lite picker is utilized, two lite storage racks may be located perpendicular to one another or in another relative orientation within reach of the robot. One lite storage rack contains and stores lites for application on the front of the insulated glass unit while the second lite storage rack contains and stores lites for use on the back of the insulated glass unit. The robot lite picker may include a glass gripper that includes both glass gripping cups and roller assemblies that can be placed in alignment with roller assemblies of the vertical glass support as lites are transported by conveyor into the washer. The glass gripping cups apply sufficient gripping force to lift and manipulate glass panes of the maximum size that the line is designed to handle.

The washer, according to an example embodiment of the invention, is generally conventional and cleans the lites. According to an example embodiment of the invention, the washer cleans the lites one at a time as they are conveyed in tandem fashion along the assembly line.

The vertical gas filling and wetting station, according to an example embodiment, generally comprises a vertical conveyor and a gas fill enclosure.

The vertical conveyor, according to an example embodiment, generally includes vertical support and a conveyor. The vertical support, according to an example embodiment of the invention, is generally a rear wall with an in-feed side and an out-feed side that supports a lite that is being held in a substantially vertical orientation.

The vertical support, according to an example embodiment of the invention, generally includes an in-feed side, a rear wall, and an out-feed side, and permits a lite to be held at a substantially vertical orientation.

The rear wall, according to an example embodiment of the invention, is generally co-planar with the support platform. For example, the rear wall may be situated slightly above the conveyor to support a substantially vertical lite as it moves along the conveyor. The in-feed side, according to an example embodiment of the invention, is on the side of the rear wall that is adjacent to the washer. The out-feed side, according to an example embodiment of the invention, is generally on the opposite edge of the rear wall from the in-feed side.

The conveyor, according to an example embodiment of the invention, is parallel to the ground and generally aligned with the conveyor of the automated lite picker. For example, the conveyor may extend from the in-feed side to the out-feed side of the vertical support, along the bottom edge of the rear wall.

The gas fill enclosure, according to an example embodiment of the invention, generally comprises a movable door, a terminal door, and a gas source. The gas fill enclosure generally creates a 5-sided enclosure that permits air to escape from the unobstructed sixth side as dense gas fills the space between the two lites. For example, the movable door and the terminal door may comprise two sides of the 5-sided enclosure, a first lite and a second lite may comprise two sides of the 5-sided enclosure, and the bottom spacer near the conveyor may form the bottom of the 5-sided enclosure, and air or gas may escape from the unobstructed top side.

The movable door, according to an example embodiment of the invention, generally comprises a movable panel proximate the in-feed side of the vertical support that is shiftable between at least a gas-filling position and a resting position. The gas-filling position may generally be defined by the movable door abutting one edge of the lite, in the direct path of conveyance along the assembly line. For example, the gas-filling position of the movable door may be near the in-feed side of the rear wall with the movable door in a generally vertical orientation. The resting position may generally be defined by the movable door being located out of the direct path of conveyance along the assembly line, apart from the edge of a lite. For example, the resting position of the movable door may be in a generally vertical orientation to either side of the conveyor, or in a generally horizontal orientation co-planar with the conveyor.

The terminal door, according to an example embodiment of the invention, may generally be situated opposite the movable door on the gas fill enclosure at a distance sufficient to accommodate the presence of lites between the terminal door and the movable door. For example, the terminal door may comprise a vertical member perpendicularly coupled to the end of the conveyor at the out-feed side of the rear wall.

In an example embodiment of the invention, the terminal door may be fixed in position.

According to an alternative embodiment of the invention, the movable and the terminal door may each be movable or otherwise adjustable, to facilitate the manufacture of different IGU sizes and shapes. For example, both doors may have a gas-filling position, located proximate opposing edges of the 5-sided enclosure defined by two lites, and a resting position, located near opposing outer edges of the gas fill enclosure. In operation, each door may move from the outer edges of the gas-fill enclosure to abut corresponding edges of the lites as the gas is injected into the enclosure. After the gas-filling process is complete, each door in this example embodiment may then return to the respective resting position.

The gas source, according to an example embodiment of the invention, generally includes a plurality of nozzles or ports configured to inject a filling gas into the spacer-created cavity between two lites prior to complete mating of the two lites with the spacer. In an example embodiment of the invention, the gas source may be situated within at least one of the movable door and the terminal door. For example, the gas source may include a plurality of nozzles or ports in operable fluid communication with the supply of the filling gas under pressure. Appropriate valves and controls as known to those skilled in the art are also included. The filling gas may comprise a gas that is denser than air, for example sulfur hexafluoride or a noble gas such as argon.

The spacer application robot, according to an example embodiment, generally comprises a robot support track, a robot base support platform, and an articulated robot arm.

The robot support track, according to an example embodiment of the invention, generally comprises support beams that are perpendicularly coupled to and co-planar with the applicator track, extending away from the assembly line. For example, the robot support track may be perpendicularly coupled to the side of the applicator track that is opposite the vertical gas filling and wetting station. In one embodiment of the invention, the robot support track may comprise two parallel beams that are resting on the ground. Alternatively, the robot support track may be suspended from an overhead support, such as tracks, resting on a platform, or otherwise not resting on the ground.

The robot base support platform, according to an example embodiment of the invention, may be movably coupled to the robot support track opposite the perpendicular applicator track coupling, enabling the robot to move along the robot support track.

The articulated robot arm assembly, according to an example embodiment of the invention, may include a movable robot arm and a glass-gripper end. According to an example embodiment of the invention, the articulated robot arm assembly may be mounted on the robot base support platform.

The movable robot arm, according to an example embodiment of the invention, is structured so the glass-gripper end can reach the gas filling and wetting station as well as the IGU storage rack. For example, the glass-gripper end may grip the front side of a first lite as the articulated robot arm assembly aligns the first lite with the applicator track application of the spacer to the back side of the first lite. The glass-gripper end may also support the first lite and the attached spacer during the gas filling and wetting process, while the primary sealant on the spacer binds the first lite to a second lite, forming an IGU. The articulated robot arm assembly may additionally align the IGU with the applicator track during the application of the secondary sealant to the trough-shaped space along the IGU's peripheral edges. The articulated robot arm may also place the IGU on the IGU storage rack.

It is notable that work is done on the opposite side of the glass lite than in conventional assembly lines. The articulated robot arm assembly grips the glass lite on the front, or outward facing side, of the lite. The articulated robot arm assembly then supports and holds the lite in position while spacer is applied to the back, or inward facing side, of the lite. In this way, multiple steps can be done at one processing location thus saving considerable space and labor in the insulated glass unit manufacturing process. In this context, back or inward side means the side of the lite that faces toward the vertical conveyor and away from the robot.

In an alternative embodiment of the invention, the assembly line may include multiple robots. For example, the assembly line may include a first robot and a second robot. The second robot, according to this embodiment of the invention, may be substantially similar in structure to the first robot, and may be placed following the first robot. According to this embodiment, the first robot supports the lite as the spacer is applied, then places it back on the conveyor, and the second robot supports the IGU as the secondary sealant is applied, then places the IGU on the IGU storage rack.

The applicator station, according to an example embodiment of the invention, generally comprises an applicator track, a spacer applicator, and a secondary sealant applicator.

The applicator track, according to an example embodiment of the invention, generally comprises horizontal rails with a first end and a second end. The first end and second end, according to an example embodiment of the invention, are generally the resting locations of the spacer and secondary sealant applicators.

The horizontal rails, according to an example embodiment of the invention, are generally parallel to the travel axis of the assembly line and perpendicularly coupled with the robot support track. For example, the horizontal rails may comprise two parallel rails situated between the assembly line and the robot. For example, the horizontal rails may be resting on the ground a short distance in front of the vertical gas filling and wetting station. Alternatively, the horizontal rails may be suspended on tracks from an overhead support.

The spacer applicator, according to an example embodiment of the invention, generally comprises a spacer applicator base, a spacer applicator support column, a spacer applicator vertical traveler, a spacer applicator head, and a spacer storage unit.

The spacer applicator base, according to an example embodiment of the invention, is generally movably coupled to one of the first end and the second end of the applicator track, with a resting position opposite the secondary sealant applicator resting position. For example, the spacer applicator track may have a resting position at the first end, and the secondary sealant applicator may have a resting position at the second end. Alternatively, the resting positions of the spacer applicator and the secondary sealant applicator could be switched. Additionally, the movable coupling of the spacer applicator base permits the spacer applicator to travel along the applicator track to an appropriate working position to apply the spacer to the lite that is held by the robot.

The spacer applicator support column, according to an example embodiment of the invention, is generally perpendicularly mounted on the spacer applicator base. In one embodiment of the invention, the spacer applicator support column may be fixedly mounted to the spacer applicator base. Alternatively, the spacer applicator support column may be rotatably and/or pivotably mounted on the spacer applicator base so the spacer applicator support column may be adjusted to facilitate the manufacture of differently sized or shaped IGUs.

The spacer applicator vertical traveler, according to an example embodiment of the invention, is movably coupled to the spacer applicator support column and may travel vertically along the spacer applicator support column.

The spacer applicator head, according to an example embodiment of the invention, is generally rotatably coupled to the spacer applicator vertical traveler, such that the spacer applicator head may apply the spacer to the back side of a lite. Back side, in this context, means the side of the lite that faces toward the vertical conveyor and away from the robot. According to an example embodiment of the invention, the rotatable coupling permits the spacer applicator head to rotate around the corners of the lite.

The spacer storage unit, according to an example embodiment of the invention, generally comprises a flexible spacer applicator head coupling, a spacer supply conduit, and stored spacer material.

The flexible spacer applicator head coupling may generally be flexibly coupled to the spacer applicator head and the spacer supply conduit. The spacer supply conduit, according to an example embodiment of the invention, holds the stored spacer material and supplies it to the spacer applicator head through the flexible spacer applicator head coupling. For example, the spacer storage unit may keep the stored spacer material in a large spool that unwinds at a rate consistent with the rate at which the spacer applicator head applies the spacer to the lite.

The secondary sealant applicator, according to an example embodiment, generally comprises a secondary sealant applicator base, a secondary sealant support column, a secondary sealant vertical traveler, and a secondary sealant applicator head.

The secondary sealant applicator base, according to an example embodiment of the invention, is generally movably coupled to the opposing end of the applicator track from the spacer applicator resting position.

The secondary sealant applicator support column, according to an example embodiment of the invention, is generally perpendicularly mounted on the secondary sealant applicator base. In one embodiment of the invention, the spacer applicator support column may be fixedly mounted to the secondary sealant applicator base. Alternatively, the secondary sealant applicator support column may be movably mounted to the secondary sealant applicator base, to permit the secondary sealant applicator support column to rotate or pivot with respect to the secondary sealant applicator base, facilitating the manufacture of differently sized and shaped IGUs.

The secondary sealant applicator vertical traveler, according to an example embodiment of the invention, is generally movably coupled to the secondary sealant applicator support column, such that the secondary sealant applicator vertical traveler may travel vertically along the secondary sealant applicator support column.

The secondary sealant applicator head, according to an example embodiment of the invention, is generally rotatably coupled to the proximal end of the secondary sealant vertical traveler, permitting the secondary sealant applicator head to pivot around the corners of an IGU as the secondary sealant applicator head applies the secondary sealant to the trough-shaped space along the peripheral edges of the IGU.

According to example embodiments of the invention, having the robot hold and support the insulated glass unit during secondary sealing reduces the need to support the glass from the bottom thereby minimizing the possibility of contamination of the insulated glass unit or the secondary sealant applied as well as reducing labor in the manufacturing process.

The IGU storage rack, according to an example embodiment of the invention, is generally situated on the opposite side of the robot from the applicator station. According to an example embodiment of the invention, the IGU storage rack permits the assembled IGUs to be stored in a substantially vertical orientation. According to one embodiment of the invention, the assembly line may include a first IGU storage rack and a second IGU storage rack. The use of two IGU storage racks, for example, increases the number of IGUs that can be manufactured in each production run because the robot can begin placing IGUs on the second IGU storage rack once the first IGU storage rack is full, without waiting for the first IGU storage rack to be replaced or emptied.

In operation, the assembly line enables automated manufacture of IGUs in a substantially vertical orientation while reducing the space, time, and employees required for production. For example, the first automated lite picker transfers a first lite from the first lite storage rack to the vertical conveyor. The conveyor then moves the first lite to the washer, and as the first lite is cleaned as a second lite may be transferred to the vertical conveyor. For example, the second automated picker may transfer the second lite to the vertical conveyor from the second lite storage rack. Alternatively, the assembly line may only include the first automated lite picker, which transfers both the first and the second lite to the conveyor.

Further alternatively, the assembly line may include a robotic glass lite picker as discussed above. In this case, the robotic glass lite picker lifts both the first glass lite and the second glass lite and places them on the conveyor for passage through the washer. The first glass lite is placed first followed by the second glass lite. Depending upon the desires of the manufacturer a glass lite with low-E glass can be placed first or second so that the low-E glass is on the front or back side of the completed insulated glass unit at the end of the manufacturing process.

Once the first lite is cleaned, the conveyor moves the first lite out of the washer to the vertical gas filling and wetting station. For example, the first lite may exit the washer simultaneously as the second lite enters the washer. The first robot then uses the glass-gripper head to align the first lite with the applicator track. The spacer applicator then moves into an appropriate working position from the spacer applicator resting position and applies the spacer sequentially along each edge of the back side of the first lite.

After the spacer has been applied to the back side of the first lite and the washer has cleaned the second lite, the first robot may move the first lite toward the second lite, so that the gas filling process may be completed as the two lites and the spacer are assembled into an IGU. The robot aligns the bottom edges of the first lite and the second lite with the conveyor to form three sides of the 5-sided enclosure. A leading vertical edge of the lites may be aligned with the terminal door of the gas fill enclosure, opposite a trailing vertical edge of the lites that may be aligned with the gas-filling position of the movable door, to complete the 5-sided enclosure.

Next, the gas source injects a non-air gas into the space between the lites, for example to displace any moisture or air before the two lites are sealed together. After the gas filling process is complete, the first robot presses the two lites together. An adhesive on the spacer seals the back side of the first lite to the front side of the second lite, forming an IGU. The first robot may then align the IGU with the applicator track, so that the secondary sealant applicator can seal the peripheral edges of the IGU. Finally, the first robot articulates as necessary to place the IGU on the IGU storage rack.

Alternative embodiments utilizing the second robot may operate in substantially the same way. In this example, the first robot can grip the front side of the first lite, and then align the first lite with the applicator track so the spacer applicator can apply the spacer to the back side of the first lite. Next, the first robot may align the first lite with the second lite to form the 5-sided enclosure, fill the 5-sided enclosure with gas, and seal the two lites together, as described above, forming a first IGU. Then, the first IGU may be conveyed into alignment with the second robot. The second robot may align the first IGU with the applicator track as the secondary sealant applicator applies the secondary sealant to the first IGU's peripheral edges. Finally, the second robot may articulate to place the first IGU on the IGU storage rack. In this embodiment, the first robot can assemble a second IGU while the secondary sealant is applied to the first IGU. Thus, the first robot and the second robot may operate concurrently to reduce the manufacturing time.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
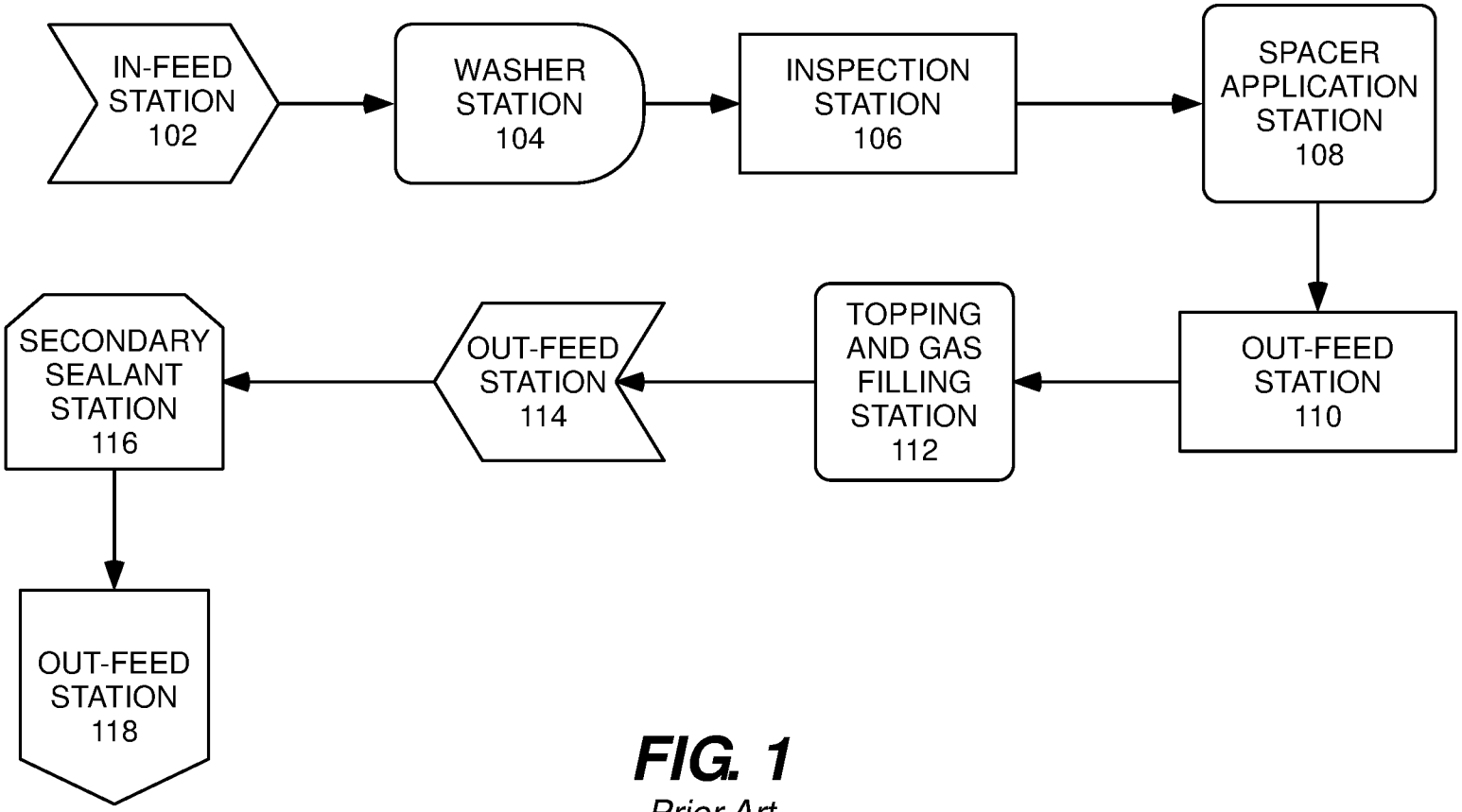
FIG. 1 Prior Art
FIG. 1 is a block diagram of an example insulated glass unit assembly sequence according to the prior art.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Figure 5:
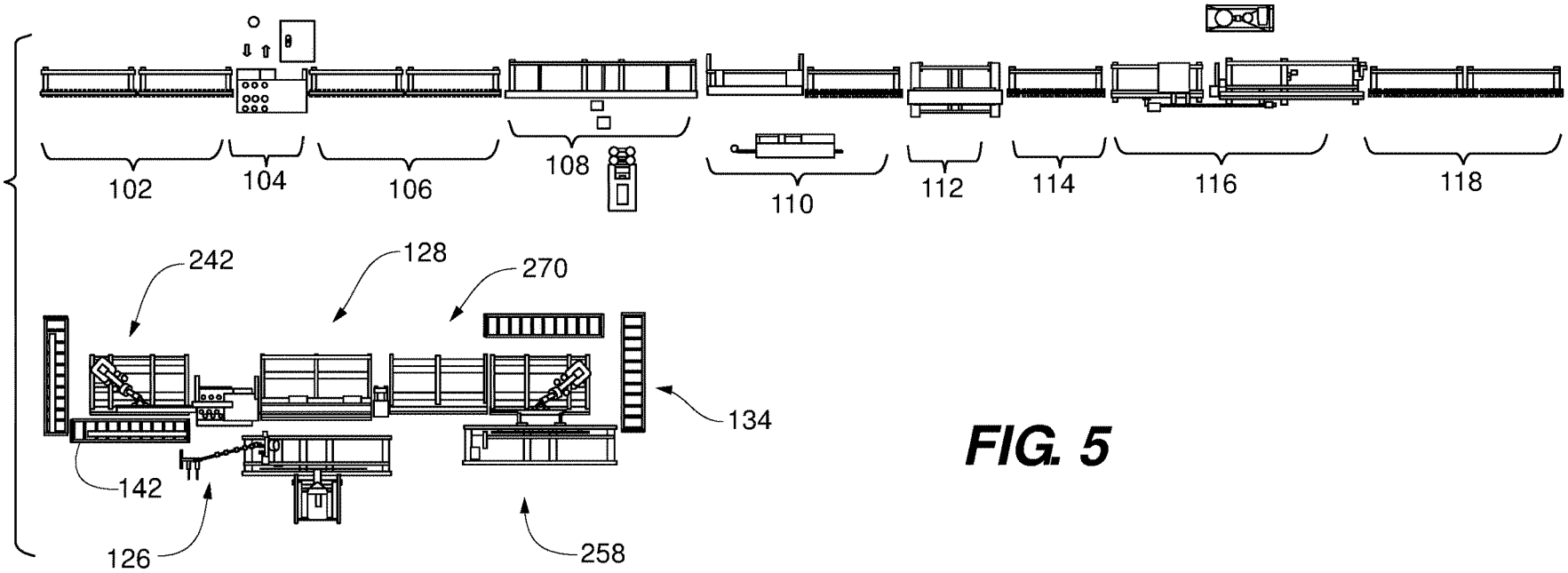
FIG. 5 is a plan view comparing the floor plan and space requirements of a conventional insulated glass unit assembly line in comparison with an example embodiment of the invention.

Referring to FIG. 1, an example prior art assembly line 100 and method is depicted in a block diagram. According to the example prior art, in-feed station 102 is followed by washer station 104. Washer station 104 is followed by inspection station 106. Inspection station 106 transfers insulated glass lites to the spacer application station 108 at which spacer material is applied to an insulated glass lite. The spacer applied light is then conveyed to outfeed station 110 and further conveyed to topping and gas filling station 112. At topping and gas filling station 112 a second light is applied on an opposing side of the spacer material from the first lite to create an insulated glass unit which is primary sealed. In addition, a non-air gas, such as argon, is optionally placed within the space between the lites formed by the spacer material to increase the energy efficiency of the insulated glass unit. The insulated glass unit is next conveyed to out-feed station 114 and then to secondary sealant station 116. At secondary sealant station 116, secondary sealant is applied around a periphery of the insulated glass unit. The completed insulated glass unit is then transferred to out-feed station 118, from which it is removed for storage and/or delivery. As can be seen, the prior art manufacturing approach includes many steps and results in an assembly line of considerable length, requiring a substantial amount of physical space in a manufacturing facility. In the conventional facility depicted in FIG. 5, the length is approximately 157'9" with the capability of processing insulated glass units up to ten feet in length.

Figure 2:
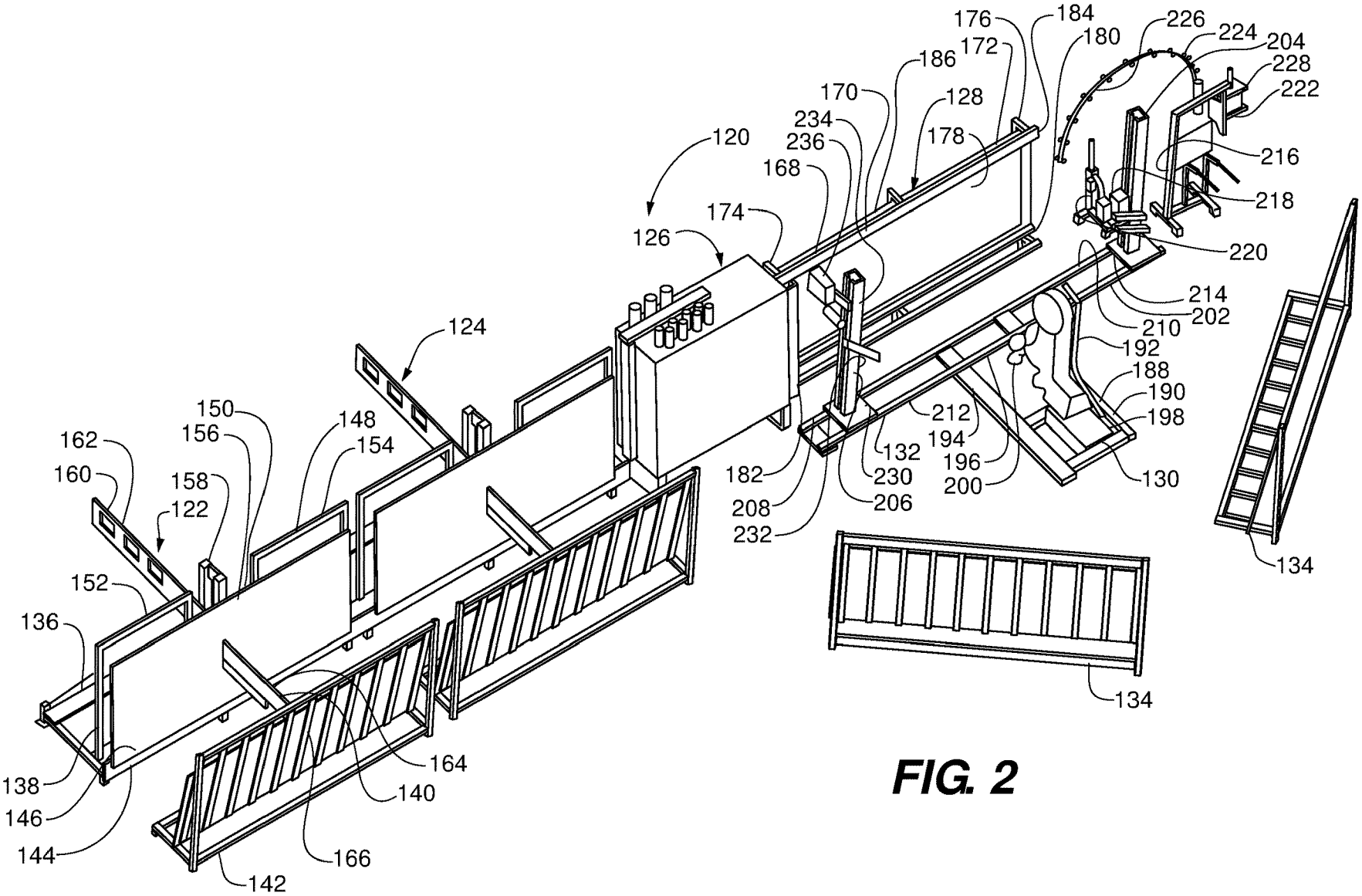
FIG. 2 is a perspective view of an insulated glass unit assembly line according to an example embodiment of the invention.

Referring now to FIG. 2, an example insulated glass assembly line 120 according to an example embodiment of the invention is depicted. Insulated glass assembly line 120 generally includes first automated lite picker 122, second automated lite picker 124, lite washer 126, vertical gas filling and wetting station 128, robot 130, applicator station 132 and IGU storage racks 134.

First automated lite picker 122 generally includes ground engaging support 136, vertical conveyor 138, picker arm 140 and lite storage rack 142.

Ground engaging support 136 supports vertical conveyor 138. Vertical conveyor 138 generally includes support platform 144, conveyor 146 and support frames 148. Support platform 144 and conveyor 146 present a horizontal surface upon which lites 150 rest as lites 150 are conveyed along IGU assembly line 120 by movement of conveyor 146.

Conveyor 146 may conveniently be made as a belt conveyor or a roller conveyor. Other conveyors known to those skilled in the art may be utilized as well.

Support frames 148 generally include pre-picker arm support frame 152 and post picker arm support frame 154. Each of support frames 148 present roller beams 156. Roller beams 156 may include roller wheels, roller bearings or other roller structures.

Picker arm 140 is supported by picker arm vertical support column 158. Picker arm 140 generally includes extension arm track 162 coupled to and supported by picker arm vertical support column 158 and extension arm slide 164 which is slidably supported within extension arm track 162. Extension arm slide 164 and extension arm track 162 cooperate in much the same fashion as a drawer slide and track. Extension arm slide is coupled to and supports glass gripper 166, which is configured to grip and support lites 150 typically by the application of vacuum or suction. Substantially vertical, in this context, means that the lites are held at an orientation that is less than about 25 degrees of true vertical. More typically, the lites are held within 6 to 10 degrees of true vertical, for example, at 6 degrees of true vertical.

First lite storage rack 142 is located substantially opposite from first automated lite picker and is structured to support lites 150 and is tilted slightly backwards from vertical so that lites 150 are held in place by gravity.

Second automated lite picker 124 is substantially similar to first automated lite picker 122 and includes similar structures to first automated lite picker 122. Therefore, second automated lite picker 124 will not be further described here.

Lite washer 126 is generally conventional in design and known to those of skill in the art. Lite washer 126 is structured to wash lites 150 and need not further be described here.

Vertical gas filling and wetting station 128 generally includes vertical conveyor 168 and gas fill enclosure 170.

Vertical conveyor 168 generally includes vertical support 172. Vertical support 172 includes in feed 174, outfeed 176, rear wall 178 and conveyor 180. In feed 174 is located proximate lite washer 126.

Gas fill enclosure 170 includes in feed side movable door 182 and terminal door 184. Movable door 182 may be located at an in-feed side of gas fill enclosure 170, for example proximate to in-feed side 174, and is shiftable between a gas filling position and a resting position. Terminal side door 184 may be located at a terminal side of gas fill enclosure 170, for example proximate to out-feed side 176, and is optionally shiftable between a gas filling position and a resting position. Gas fill enclosure 170 also includes gas source 186. At least one of movable door 182 and terminal door 184 may include nozzles or ports (not shown) in fluid communication with gas source 186. Alternatively, gas source 186 may be in fluid communication with conveyor 180 so that the gas is injected from the bottom of gas fill enclosure 170. Additional embodiments may include other structures or positions for gas source 186. Robot 130 generally includes robot support track 188, robot base support platform 190 and articulated robot arm assembly 192. Robot base support platform 190 is supported by robot support track 188. Robot base support platform 190 in turn, supports articulated robot arm assembly 192.

Robot support track 188 generally includes support rails 194 and perpendicular applicator track coupling 196. Support rails 194 stabilize robot support track 188.

Robot base support platform 190 includes movable robot dolly 198. Movable robot dolly 198 is movably supported on robot support track 188 to facilitate travel of robot 130 along robot support track 188.

Articulated robot arm assembly 192 generally includes movable robot arm 198 and glass gripper head 200. Articulated robot arm assembly 192 and glass gripper head 200 are of sufficient strength and mobility to support the largest size of insulated glass units expected to be processed.

Spacer application station 108 generally includes applicator track 202, spacer applicator 204 and secondary sealant applicator 206. In the depicted example embodiment, applicator track 202 is coupled to robot support track 188 at perpendicular applicator track coupling 196. Spacer applicator 204 and secondary sealant applicator 206 are movable along applicator track 202. Applicator track 202 is oriented generally parallel to insulated glass assembly line 120. Applicator track has first end 208 and second end 210. In the depicted embodiment, spacer applicator 204 has a resting position proximate first end 208 and secondary sealant applicator 206 has a resting position proximate second end 210. In the depicted embodiment, applicator track 202 includes parallel horizontal rails 212, but other configurations are also possible.

Spacer applicator 204 generally includes spacer applicator base 214, spacer applicator support column 216, spacer applicator vertical traveler support 218, spacer applicator head 220, and spacer storage unit 222. Spacer applicator base 214 rests movably on horizontal rails 212 of applicator track 202 and supports spacer applicator support column 216. Spacer applicator vertical traveler support 218 is coupled to spacer applicator support column 216, along which spacer applicator vertical traveler 218 can move vertically. Spacer applicator head 220 is movably coupled to spacer applicator vertical traveler support 218 on which spacer applicator head 220 can move rotationally and vertically. Spacer applicator head 220 is operably coupled to spacer storage unit 222 to receive a supply of spacer material.

Spacer storage unit 222 in the depicted embodiment generally includes flexible spacer applicator head coupling 224, spacer supply conduit 226 and stored spacer material 228.

Secondary sealant applicator 206 generally includes secondary sealant applicator base 230, secondary sealant support column 232, secondary sealant vertical traveler support 234 and secondary sealant applicator head 236. Secondary sealant applicator base 230 is movably supported by applicator track 202. Secondary sealant applicator base 230 supports secondary sealant support column 232, which in turn supports secondary sealant vertical traveler support 234. Secondary sealant vertical traveler 234 can move vertically along secondary sealant support column 232. Secondary sealant applicator head 236 is movably coupled to secondary sealant vertical traveler support 234, on which secondary sealant applicator head 236 can move rotationally and vertically. Secondary sealant applicator head 236 is coupled in fluid communication with a supply of secondary sealant (not shown).

IGU storage racks 134 are adapted to receive and store completed insulated glass units. IGU storage racks 134 are conventional in design and need not be further described here. They are, however, very similar in structure to the lite storage racks 142.

Figure 3:
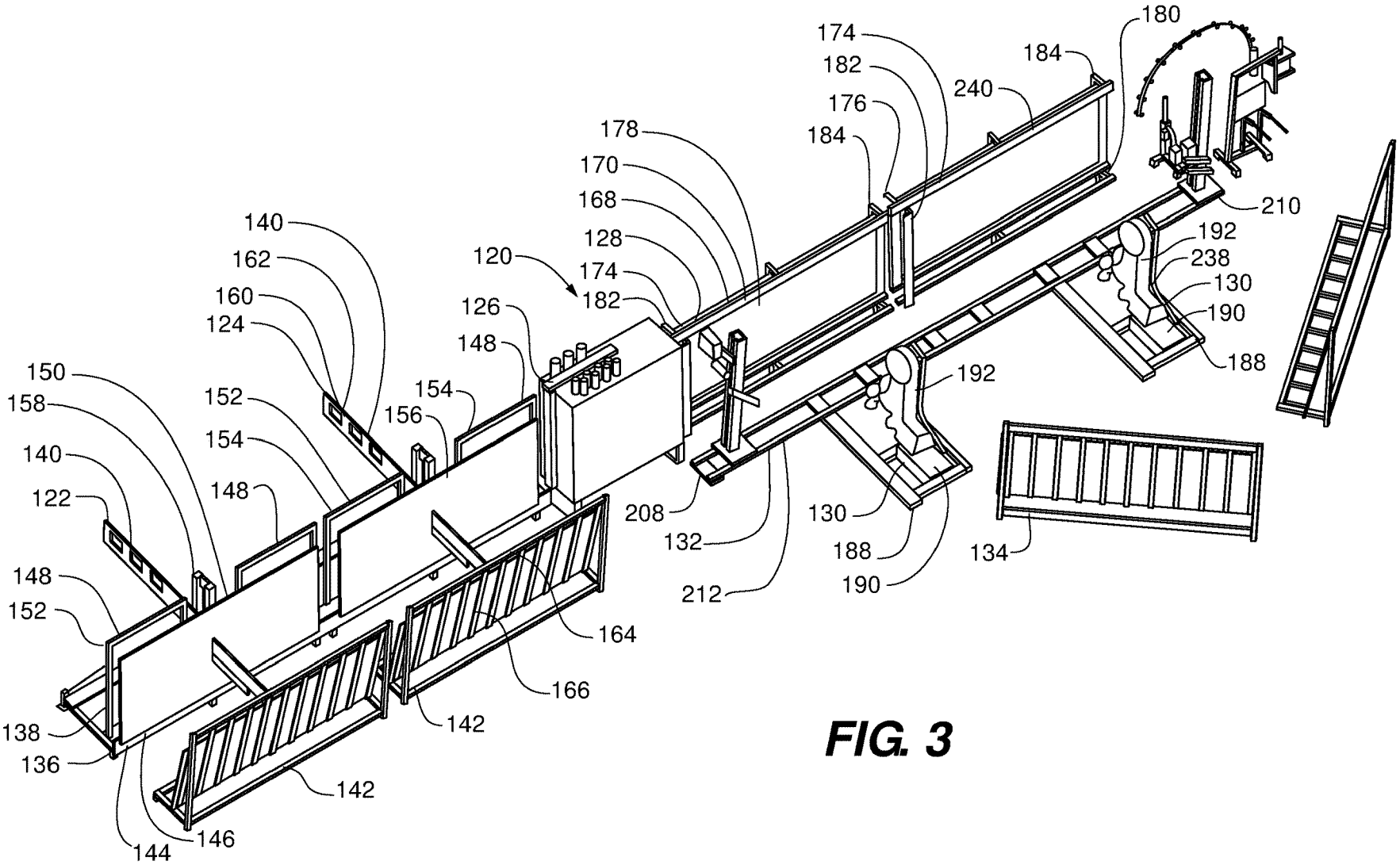
FIG. 3 is a perspective view of an insulated glass unit assembly line according to another example embodiment of the invention.

Referring to FIG. 3, an alternate embodiment of the invention is depicted. According to the embodiment depicted in FIG. 3 first robot 130 and second robot 238 are utilized. First robot 130 and second robot 238 are similar or identical in structure and need not be further described here. The depicted embodiment also includes topping and gas filling station 112 as well as a following station 240. Following station 240 is similar to topping and gas filling station 112 but need not include any gas filling structures.

Figure 4:
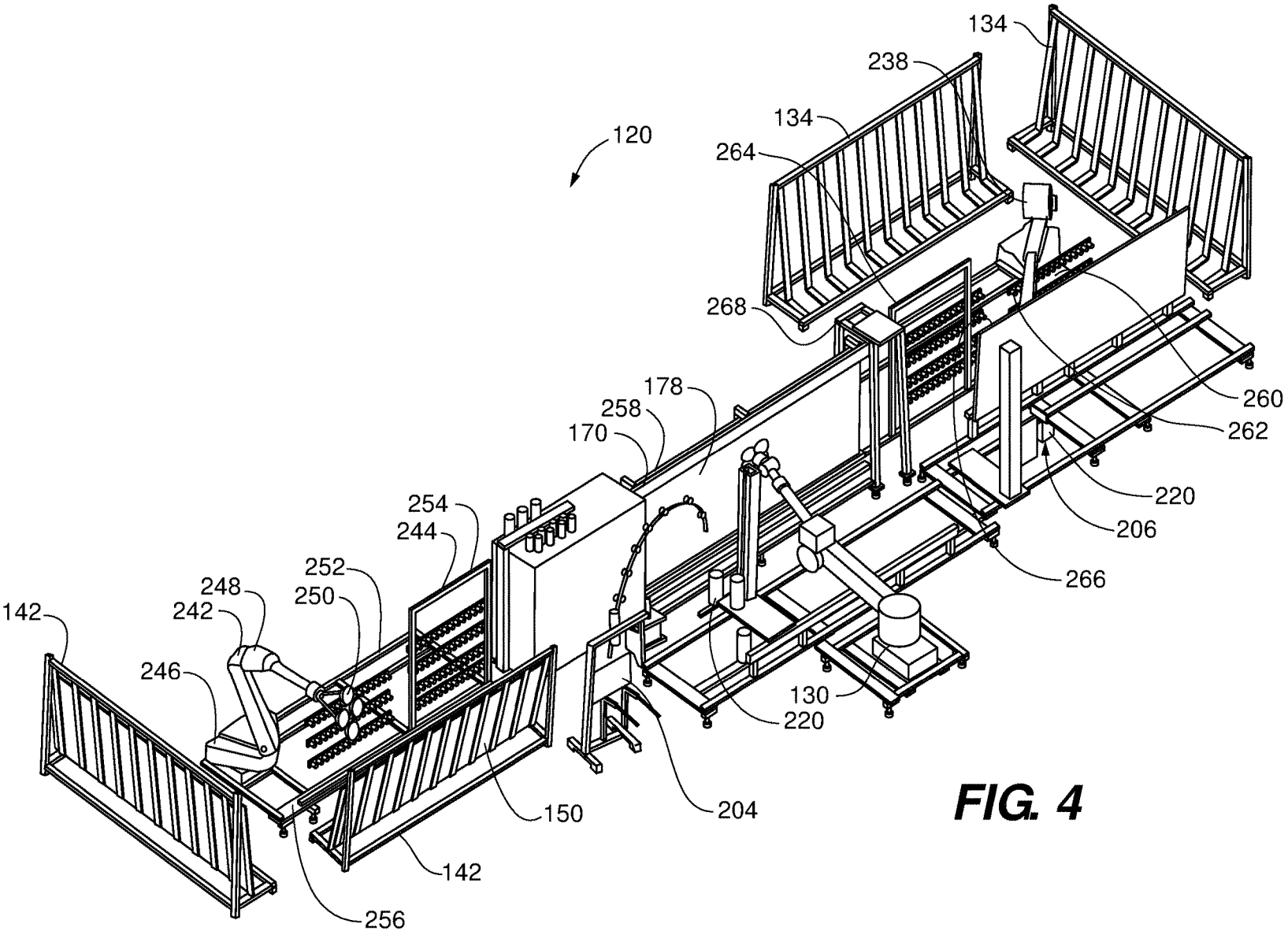
FIG. 4 is a perspective view of an insulated glass unit assembly line including a robotic glass picker and a first and second following robots according to an example embodiment of the invention.

Referring to FIG. 4, another alternative embodiment of the invention is depicted. This embodiment includes robotic lite picker 242 and robotic vertical conveyor 244. It is notable that this embodiment, like the other embodiments the invention disclosed by this specification, is substantially shorter in length than a conventional insulated glass processing facility. As can be seen by reference to FIG. 5, the depicted embodiment has an approximate length of 62'6" for a facility that is adapted to process insulated glass units up to ten feet in length. This example represents a space savings of approximately 60% over the example conventional insulated glass processing facility.

Robotic glass lite picker 242 generally includes robot base support platform 246, articulated robot arm assembly 248, glass gripper head 250 and roller beams 252. Robot base support platform 246 supports articulated robot arm assembly 248 which in turn supports glass gripper head 250 and roller beams 252. Glass gripper head 250 is arranged relative to roller beams 252 to grip glass lites 150 while glass lights 150 are in contact with or proximate to roller beams 252.

Robotic vertical conveyor 244 generally includes roller beams portion 254 and robot pass-through portion 256. The roller beams portion 254 is generally similar to roller beams 156. However, robot pass-through portion 256 is sized and shaped to accommodate roller beams 252 when articulated robot arm assembly 248 is aligned in generally coplanar alignment with roller beams portion 254.

Robotic glass lite picker 242 may be located in front of robotic vertical conveyor 244 or, as depicted in FIG. 4, behind robotic vertical conveyor 244. The embodiment of the invention depicted in FIG. 4 has an even smaller footprint and shorter length than the embodiments depicted in FIG. 2 and FIG. 3.

In contrast to the embodiment depicted in FIG. 3, in the embodiment of FIG. 4, second robot 238 is located behind secondary sealing station 258. In the depicted embodiment, the second robot 238 includes glass gripper head 260 coupled to roller beams 262. Secondary sealant conveyor 264 located at secondary sealing station 258 is similar to robotic vertical conveyor 244 in that it includes roller beams portion 254 and robot pass-through portion 266. This structure enables glass gripper head 260 with roller beams 262 to receive a primary sealed IGU, and to support and present the primary sealed IGU for secondary sealant application.

Figure 6:
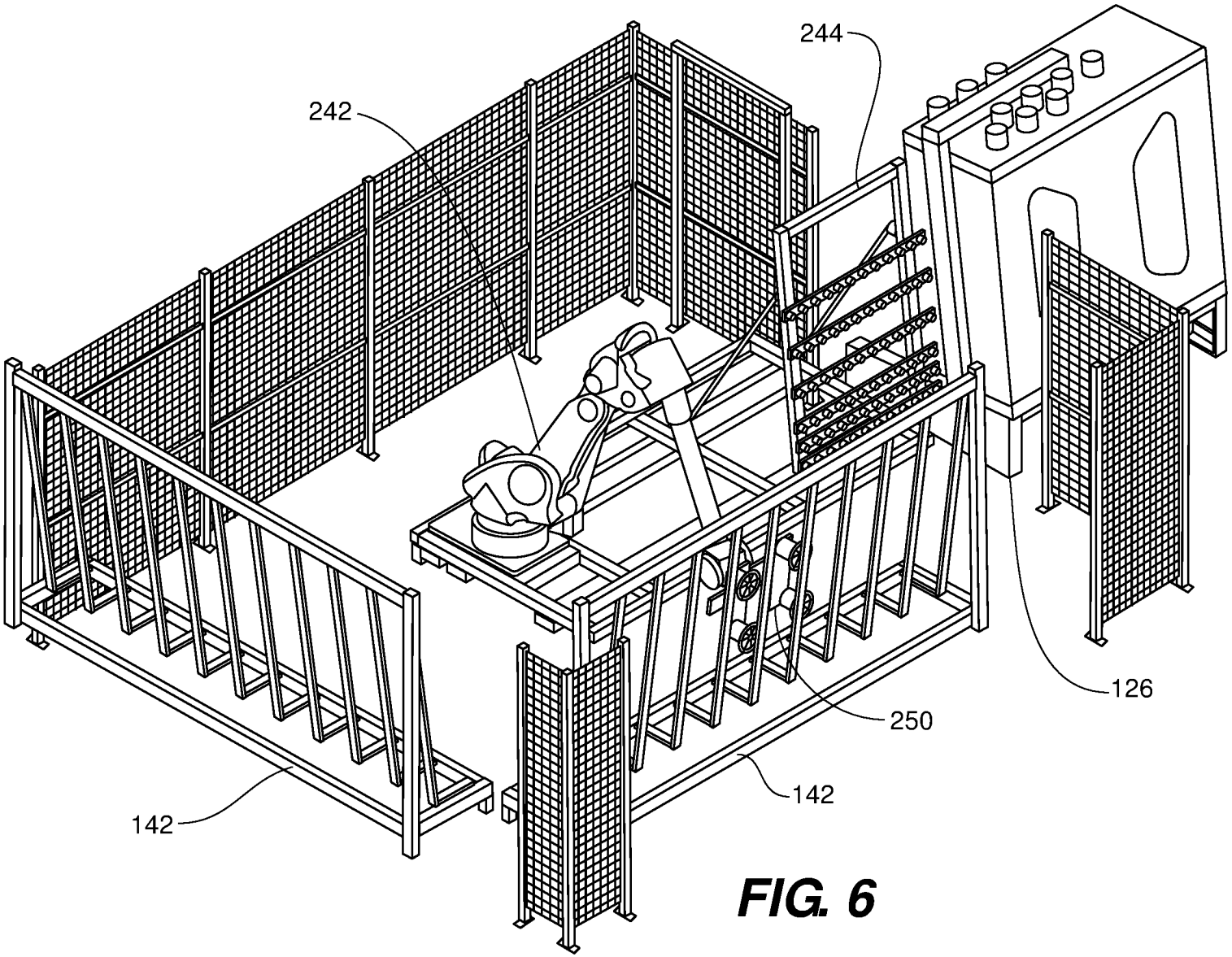
FIG. 6 is a perspective view of a robotic automated lite picker according to an example embodiment of the invention.
Figure 7:
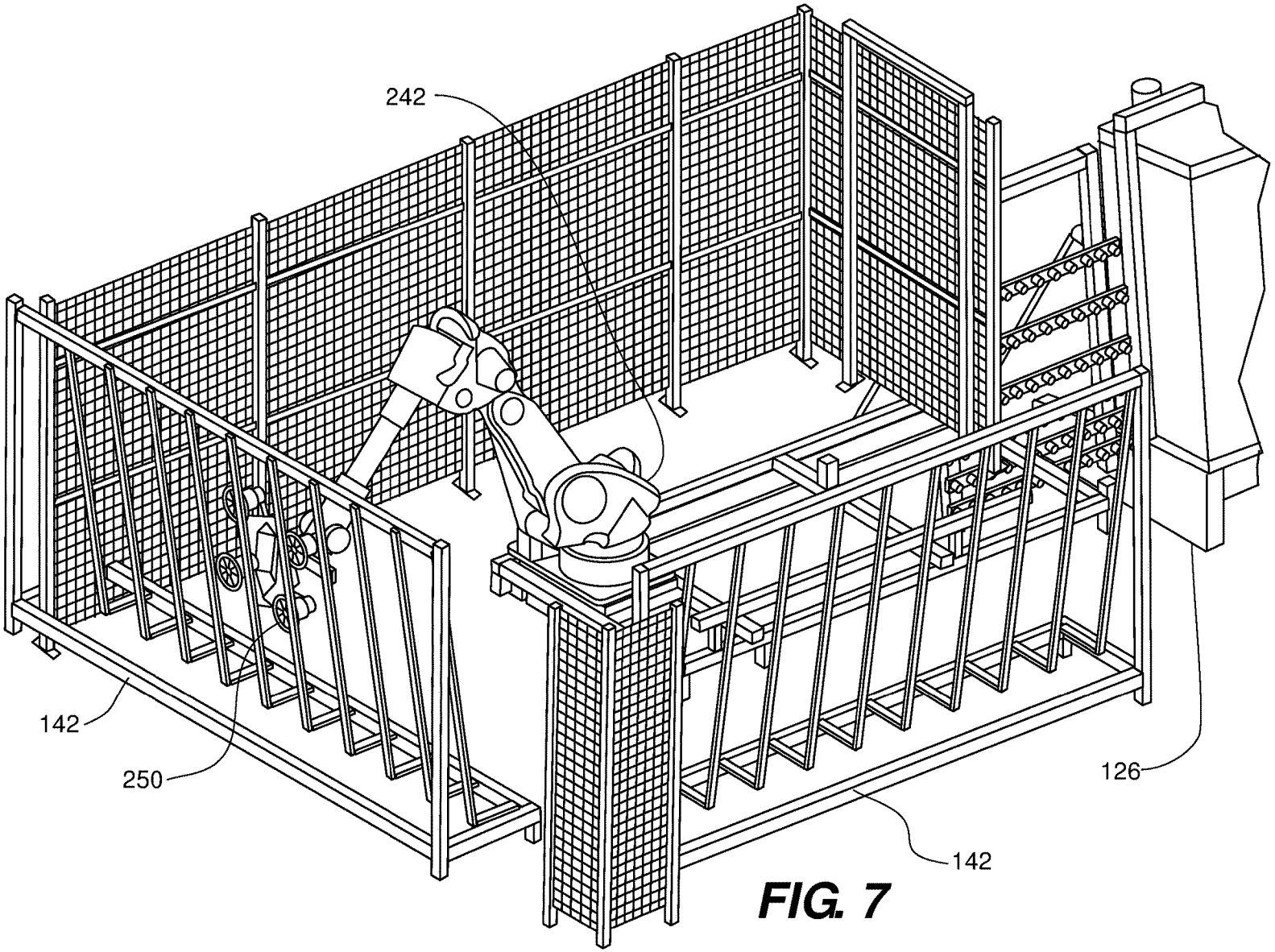
FIG. 7 is a perspective view of the robotic automated lite picker of FIG. 6 in a different orientation.
Figure 8:
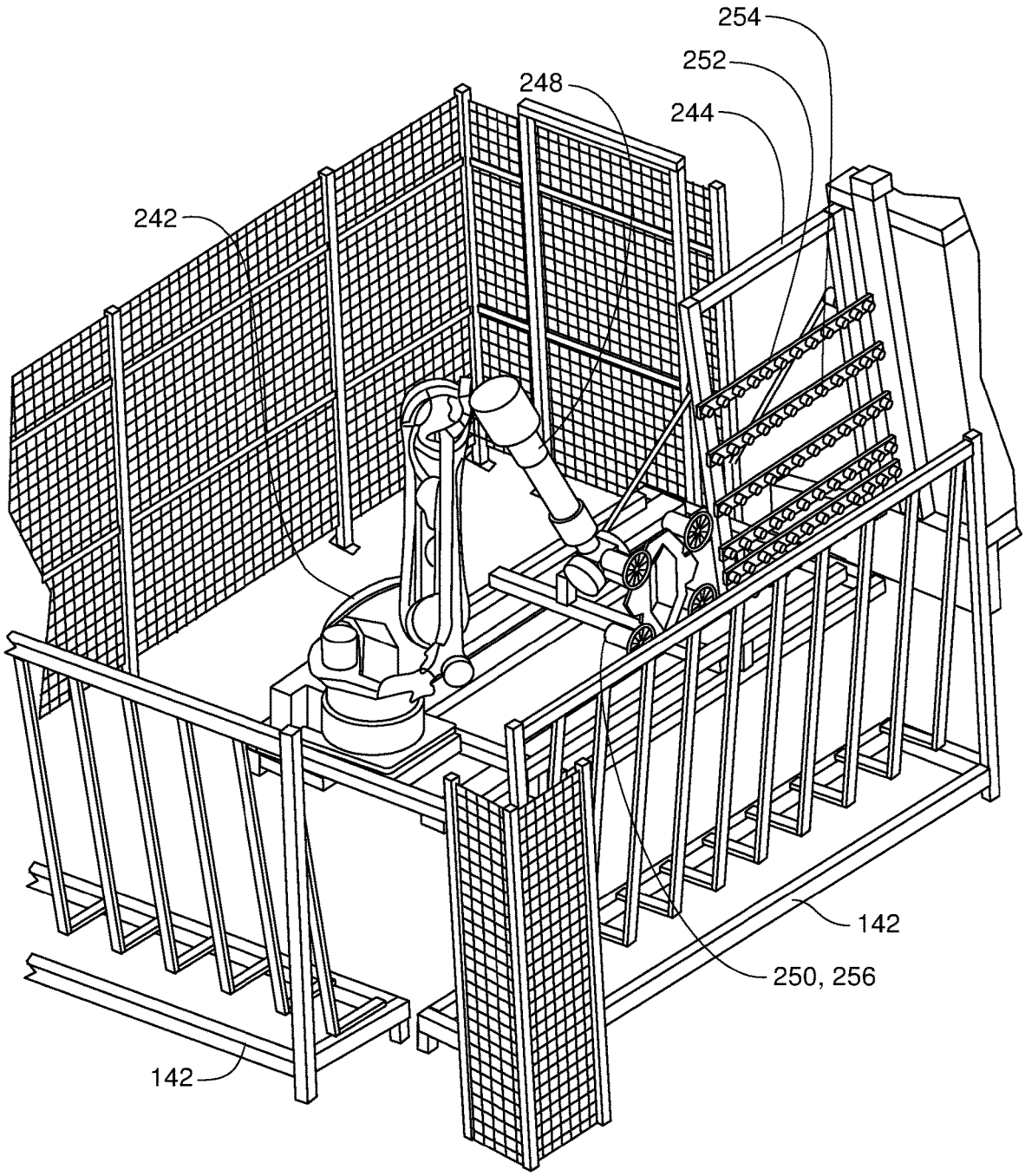
FIG. 8 is a perspective view of the robotic automated lite picker of FIG. 6 in an orientation in which a light is placed on a vertical conveyor.

FIGS. 6, 7 and 8 to depict various positions of robotic lite picker 242 as articulated during a manufacturing process.

Referring to FIG. 6, robotic lite picker 242 is depicted along with robotic vertical conveyor 244 and lite washer 126. Lite storage racks 142 are depicted as well. Glass gripper head 250, in this depiction, is located proximate to first lite storage rack 142.

Referring to FIG. 7, robotic lite picker 242 is depicted with glass gripper head 250 located proximate to second lite storage rack 142.

Referring to FIG. 8, robotic lite picker 242 is depicted with glass gripper head 250 located proximate robotic vertical conveyor 244. Here, glass gripper head 250 is generally aligned with roller beams 252 by motion of articulated robot arm assembly 248 so that glass lite 150 can be transferred to robotic vertical conveyor 244. Glass gripper head 250 can pass through robot pass-through portion 256 and align glass lite 150 with roller beams portion 254 so that the glass lite 150 can be conveyed by robotic vertical conveyor 244. Two lite storage racks 142 are present to accommodate the use of two different types of glass lites 150 in the manufacturing process. As discussed elsewhere in this application, one glass lite 150 may have a low E coating that facilitates improved energy efficiency. Another, glass lite 150 may lack such a coating. The 2 lite storage racks 142 each accommodate one of the types of glass lites 150.

Figure 9:
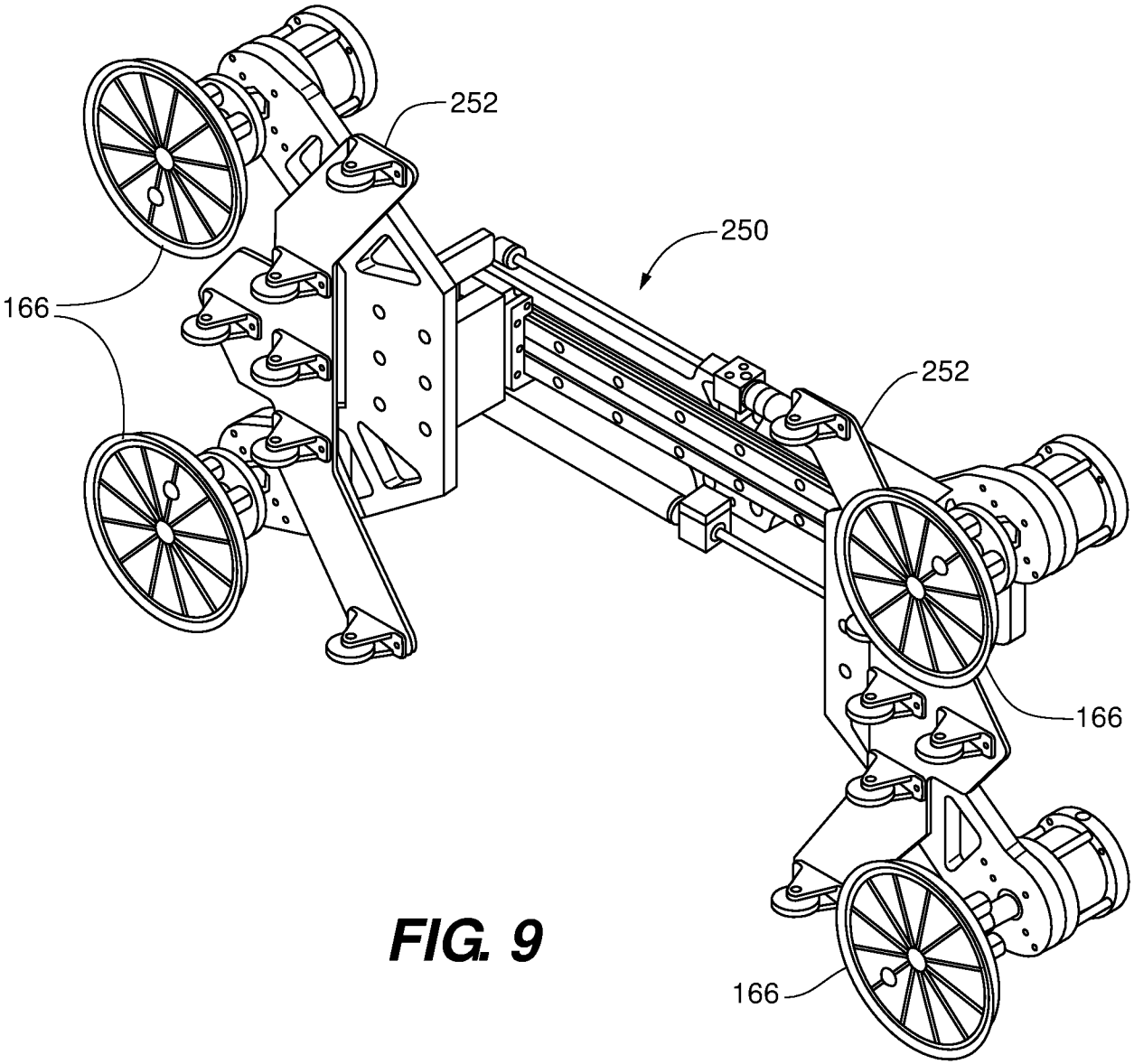
FIG. 9 is a perspective view of a glass gripper assembly with suction cups in an extended position.
Figure 10:
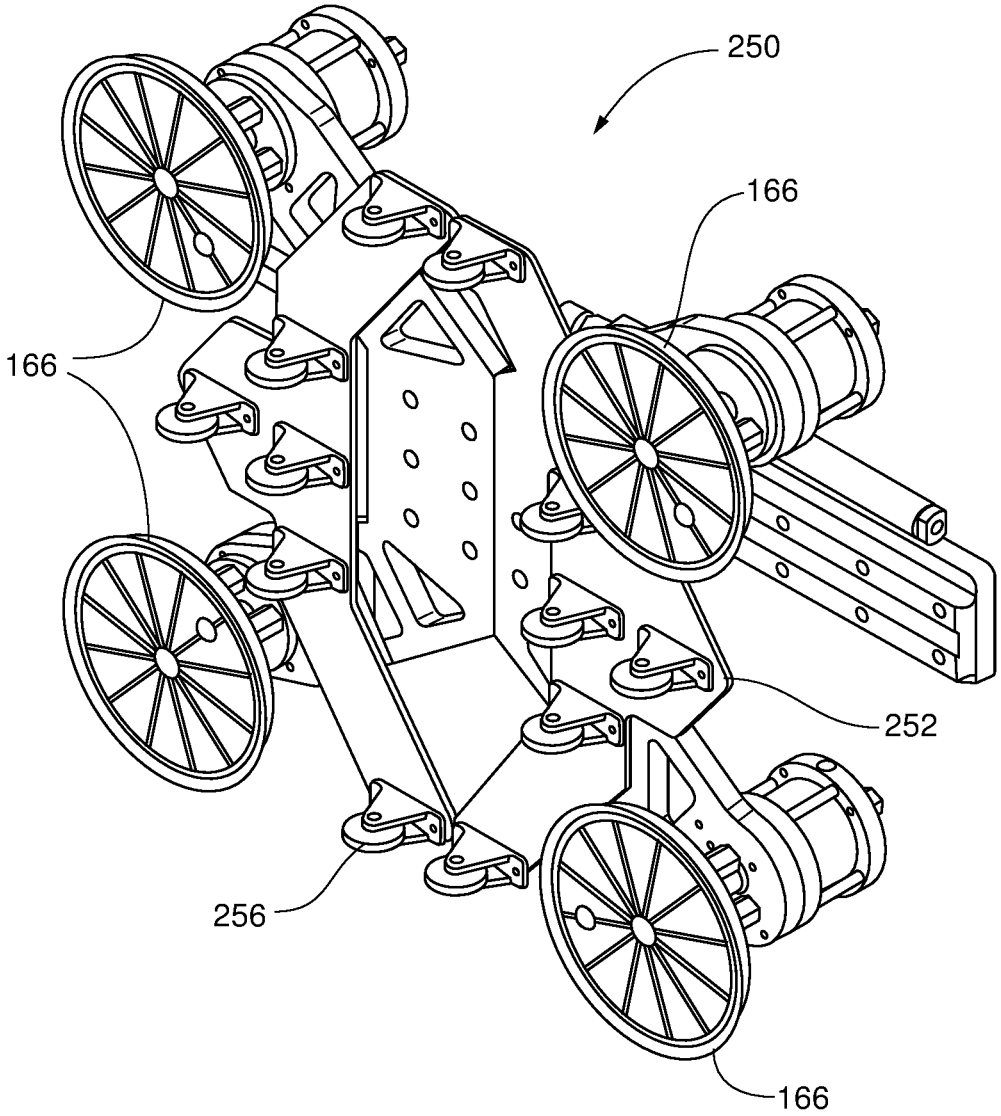
FIG. 10 is a perspective view of the glass gripper assembly with the doctrine cups in a retracted position.

Referring to FIGS. 9 and 10, an example embodiment of glass gripper head 250 is depicted.

In FIG. 9, glass gripper head 250 is depicted with glass grippers 166 spread apart which is useful when gripping and supporting larger glass lites 150.

In FIG. 10, glass gripper head 250 is depicted with glass grippers 166 moved closer together which is useful when gripping and supporting smaller glass lites 150. FIGS. 9 and 10 also depict an alternative embodiment of roller beams 252 as compared to for example, FIG. 4.

Figure 11:
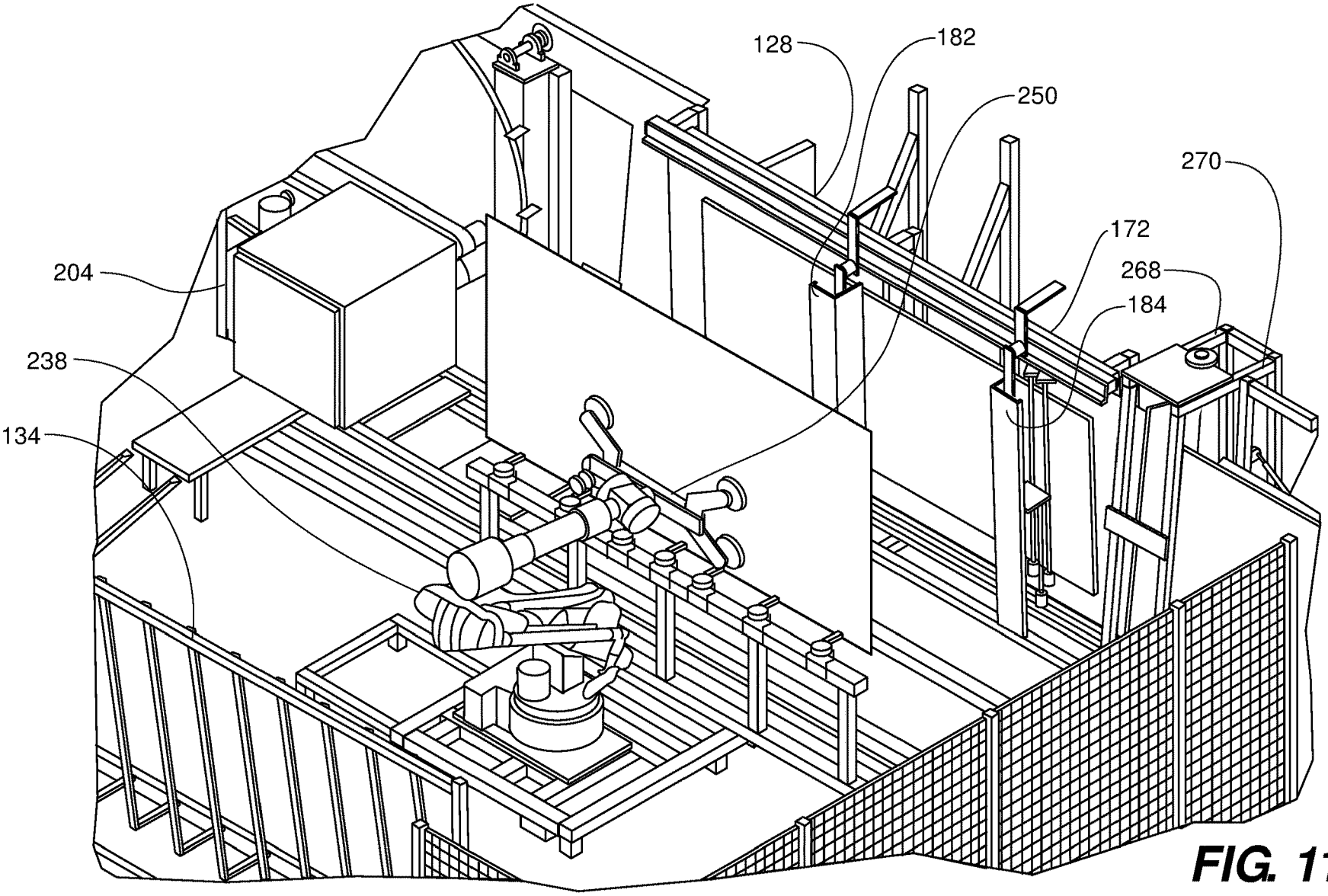
FIG. 11 is a perspective view of a gas filling and wetting station including a robot in a first orientation.
Figure 12:
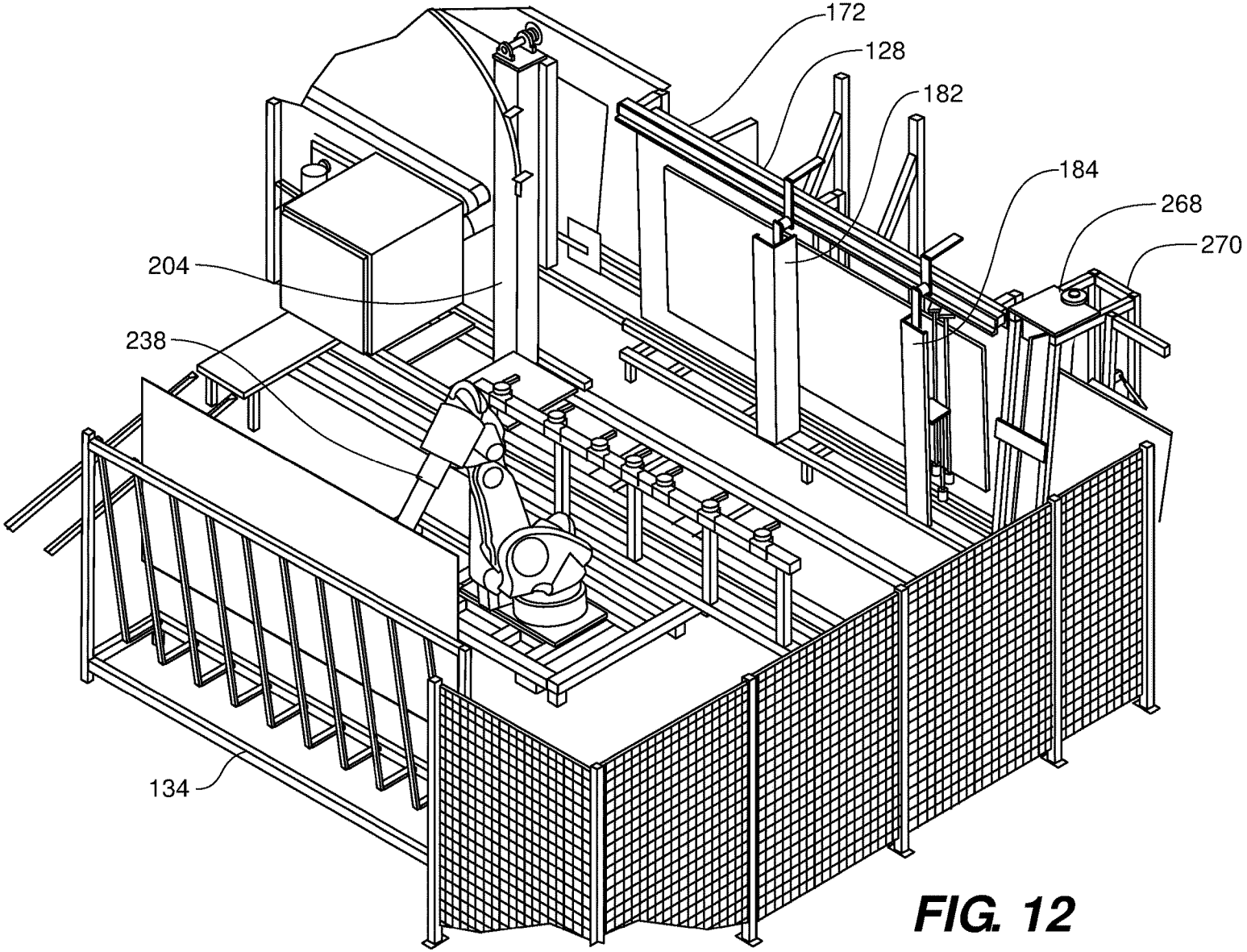
FIG. 12 is a perspective view of the gas filling and wetting station robot and a second orientation.
Figure 13:
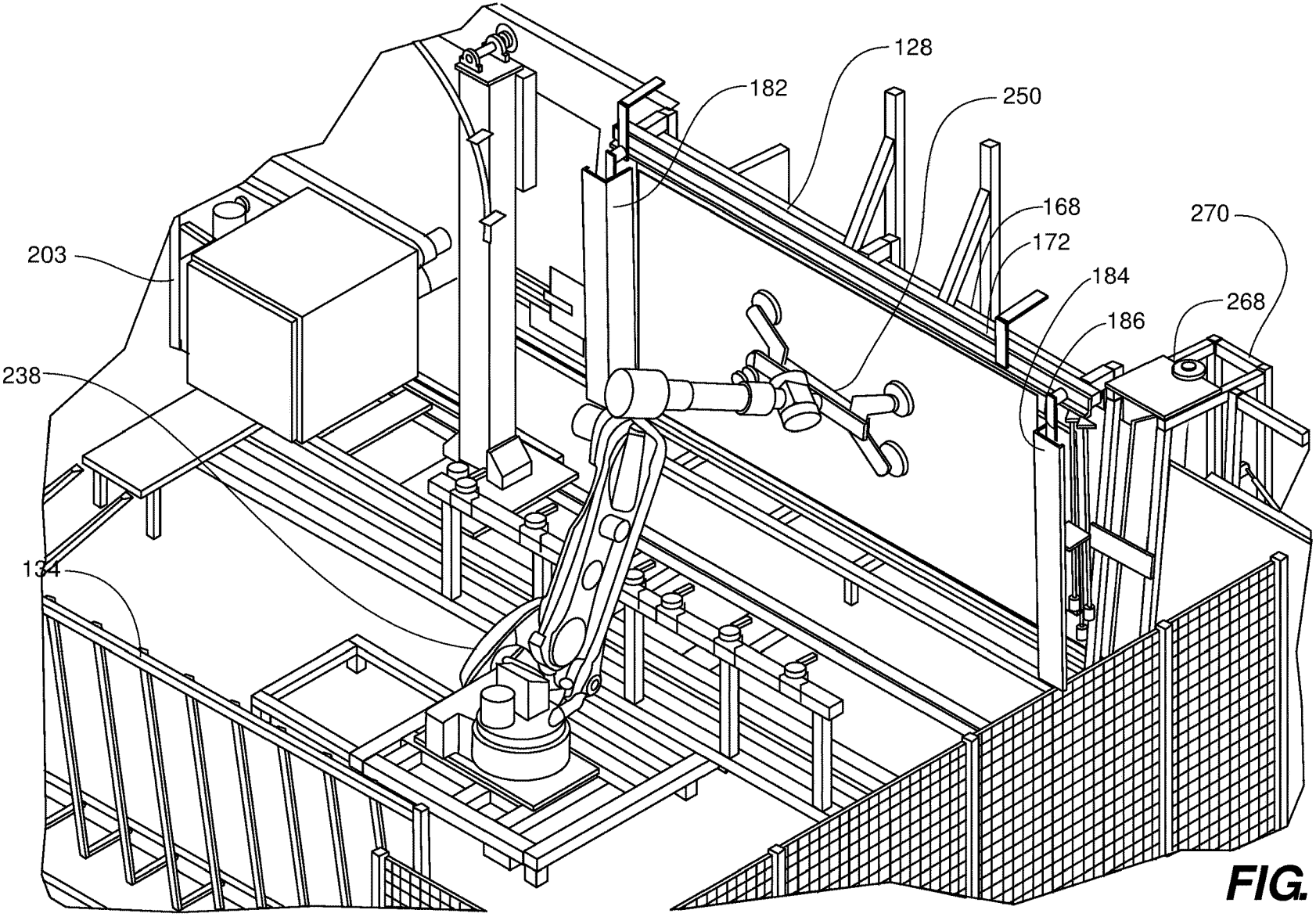
FIG. 13 is a perspective view of the gas filling and wetting station robot in a third orientation.

Referring now to FIGS. 11, 12 and 13, robotic glass filling and wetting station 128 is depicted.

In FIG. 11, third robot 238 is depicted supporting glass lite 150 proximate glass filling and wetting station 128 such that glass lite 150 with spacer material applied can be mated with a further glass lite 150 for gas filling and to create an insulated glass unit.

Referring to FIG. 12 a completed insulated glass unit is supported by third robot 238 proximate lite storage rack 142 in which completed insulated glass units may be stored.

Referring to FIG. 13, second robot 238 is depicted mating a spacer applied lite 150 to a further glass lite 150 during the gas filling and wetting process.

Figure 14:
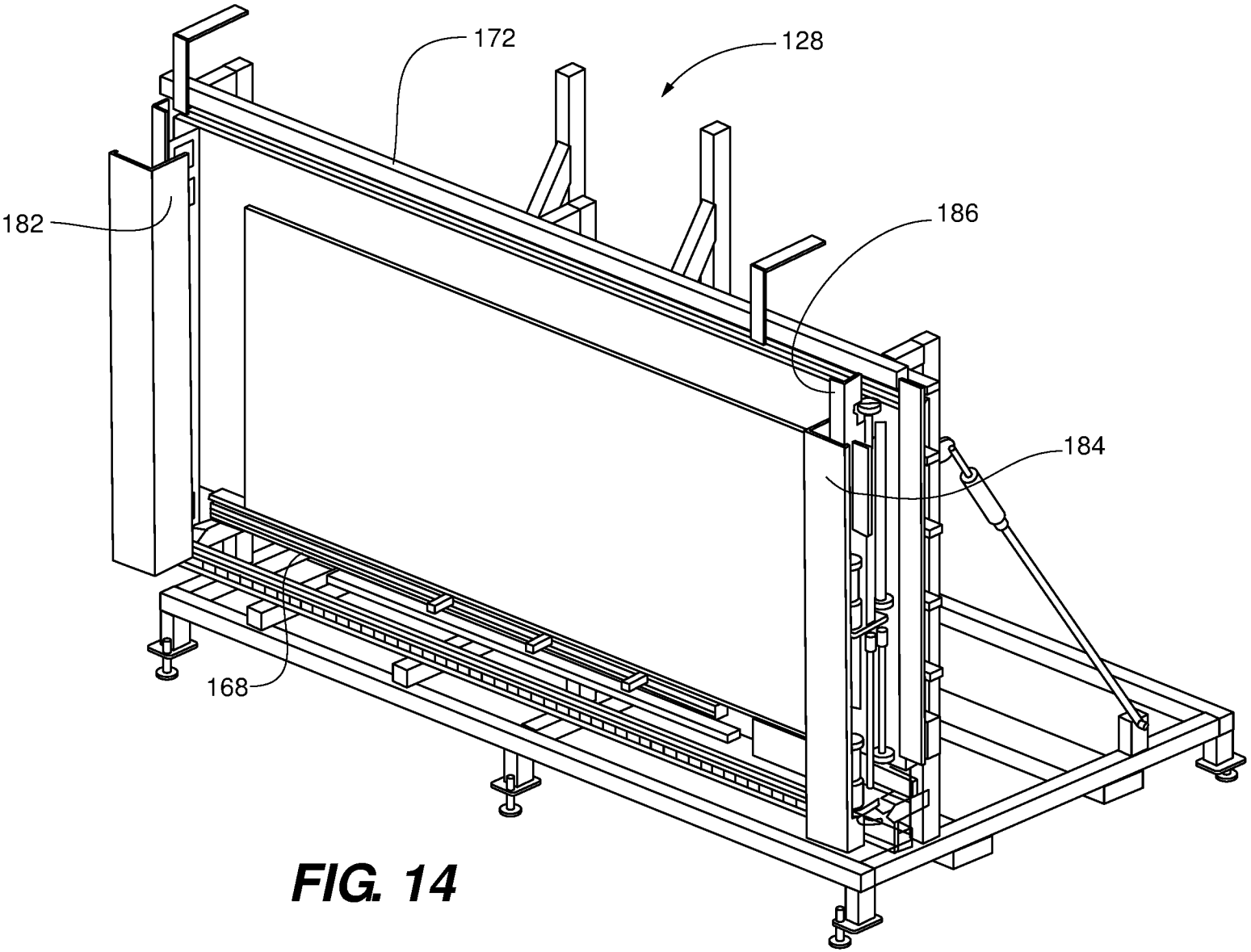
FIG. 14 is a perspective view of a gas filling enclosure.

Referring now to FIG. 14, vertical gas filling and wetting station 128 is depicted including vertical conveyor 168. Vertical conveyor 168 includes vertical support 172 and in feed side movable door 182, terminal side door 184 and gas source 186. In the depicted embodiment both in feed side movable door 182 terminal side door 184 are movable to accommodate various sized insulated glass units.

Referring now to FIGS. 15, 16, 17, and 18, applicator station 132 is depicted along with third robot 238. In each of these FIGS., third robot 238 is depicted supporting glass lite 150 proximate spacer applicator 204 at which spacer material is applied to a back side of the glass lite 150.

Figure 15:
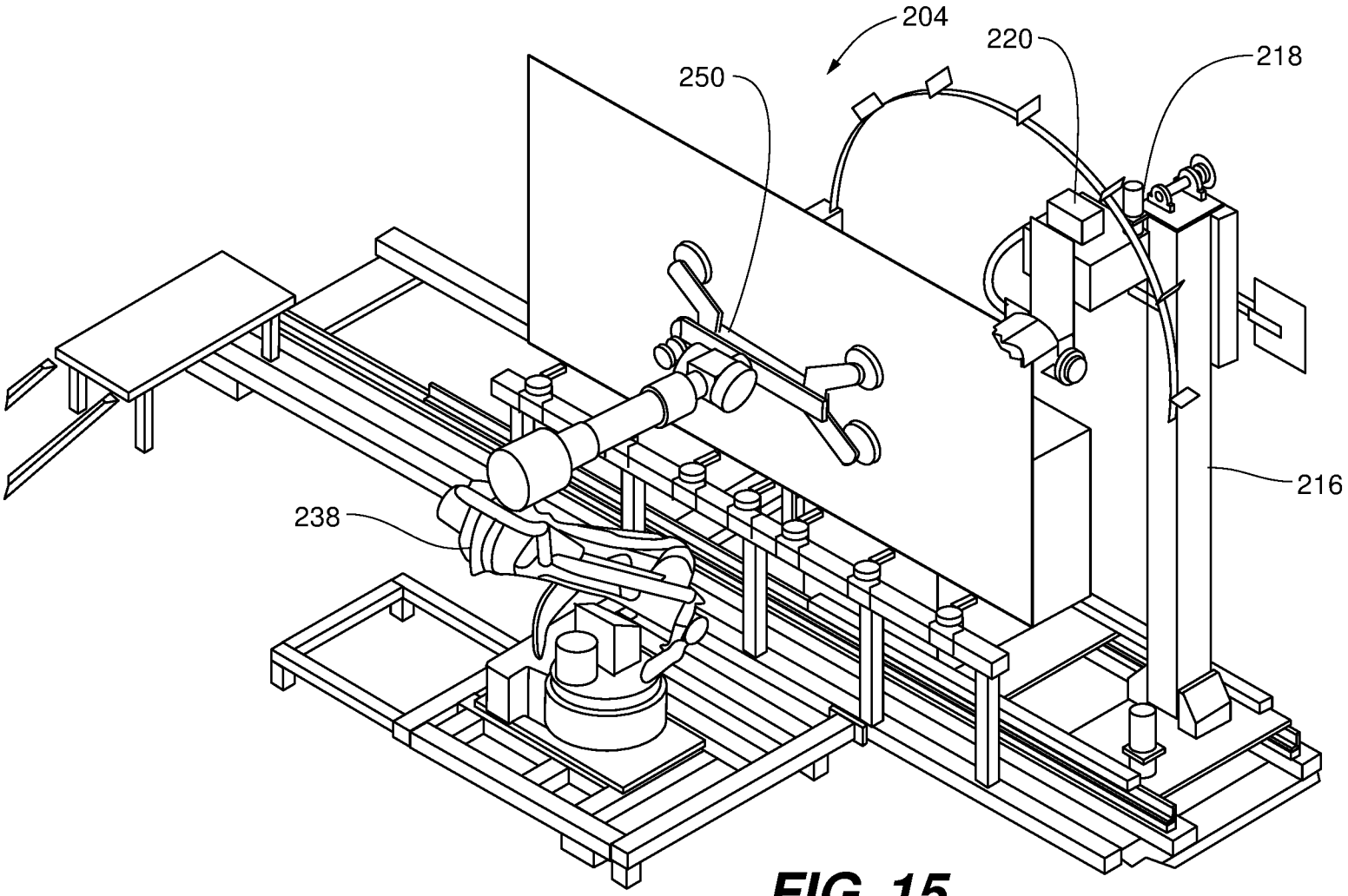
FIG. 15 is a perspective view of a spacer applicator robot and a spacer applicator station according to an example embodiment of the invention.

In FIG. 15, spacer applicator head 220 is depicted at the beginning of spacer application proximate an upper right corner of the glass lite 150.

Figure 16:
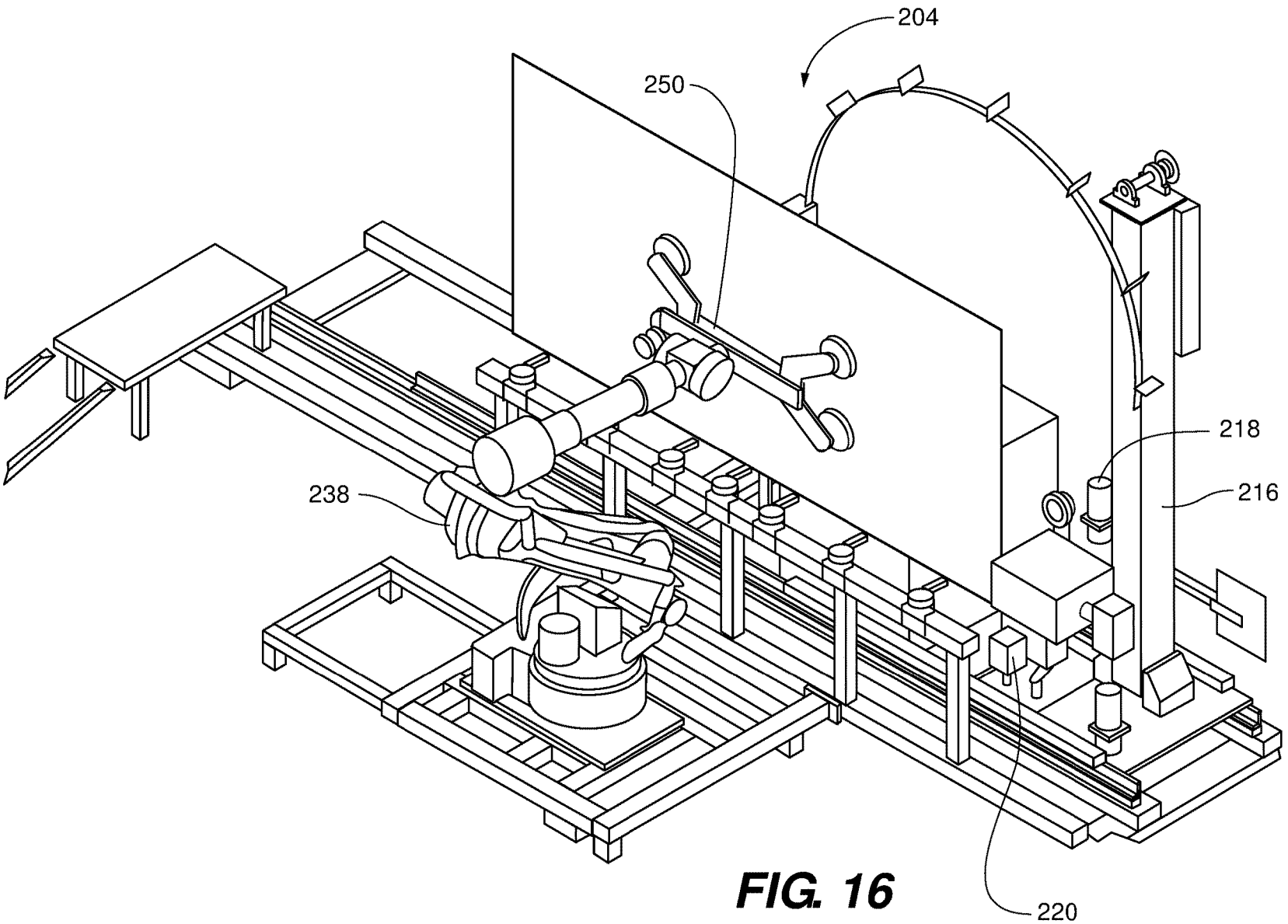
FIG. 16 is another perspective view of the spacer applicator robot and the spacer applicator station according to an example embodiment of the invention.

In FIG. 16, spacer applicator head 220 is depicted at a lower right corner of glass lite 150 having applied spacer material to the right edge glass lite 150.

Figure 17:
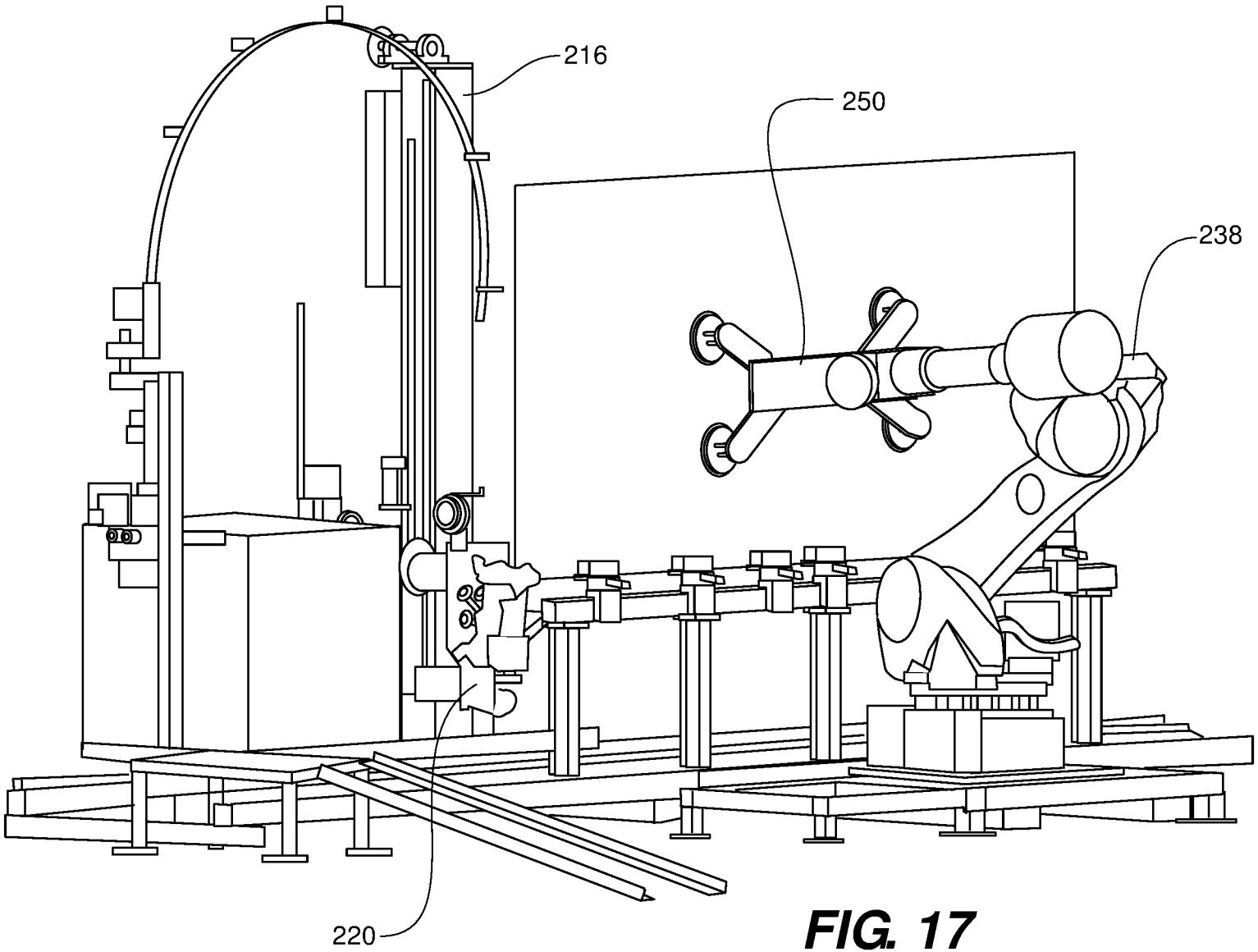
FIG. 17 is another perspective view of the spacer applicator robot and spacer application station according to an example embodiment of the invention.

In FIG. 17, spacer applicator head 220 is depicted at a lower left corner of glass lite 150 having applied spacer material to the right edge of glass lite 150 and the bottom edge of glass lite 150.

Figure 18:
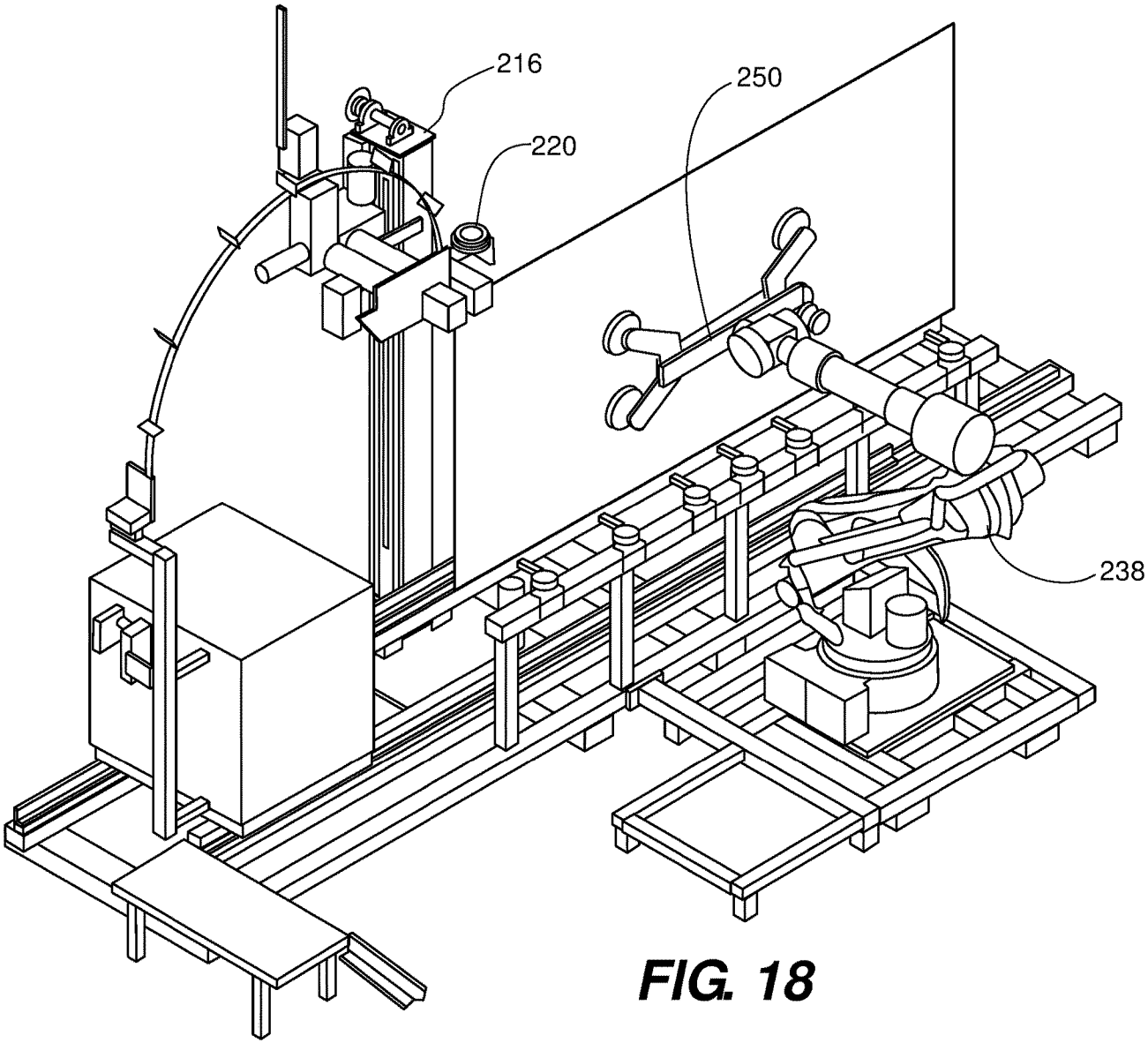
FIG. 18 is another perspective view of the spacer applicator robot and spacer application station.

In FIG. 18, spacer applicator head 220 is depicted at an upper left corner of glass lite 150 having applied spacer material to the right edge of glass lite 150, the bottom edge of glass lite 150 and the left edge of the glass lite 150. Spacer applicator head 220 that applies spacer to a top edge of the glass lite 150 returning to the position depicted in FIG. 15.

Figure 19:
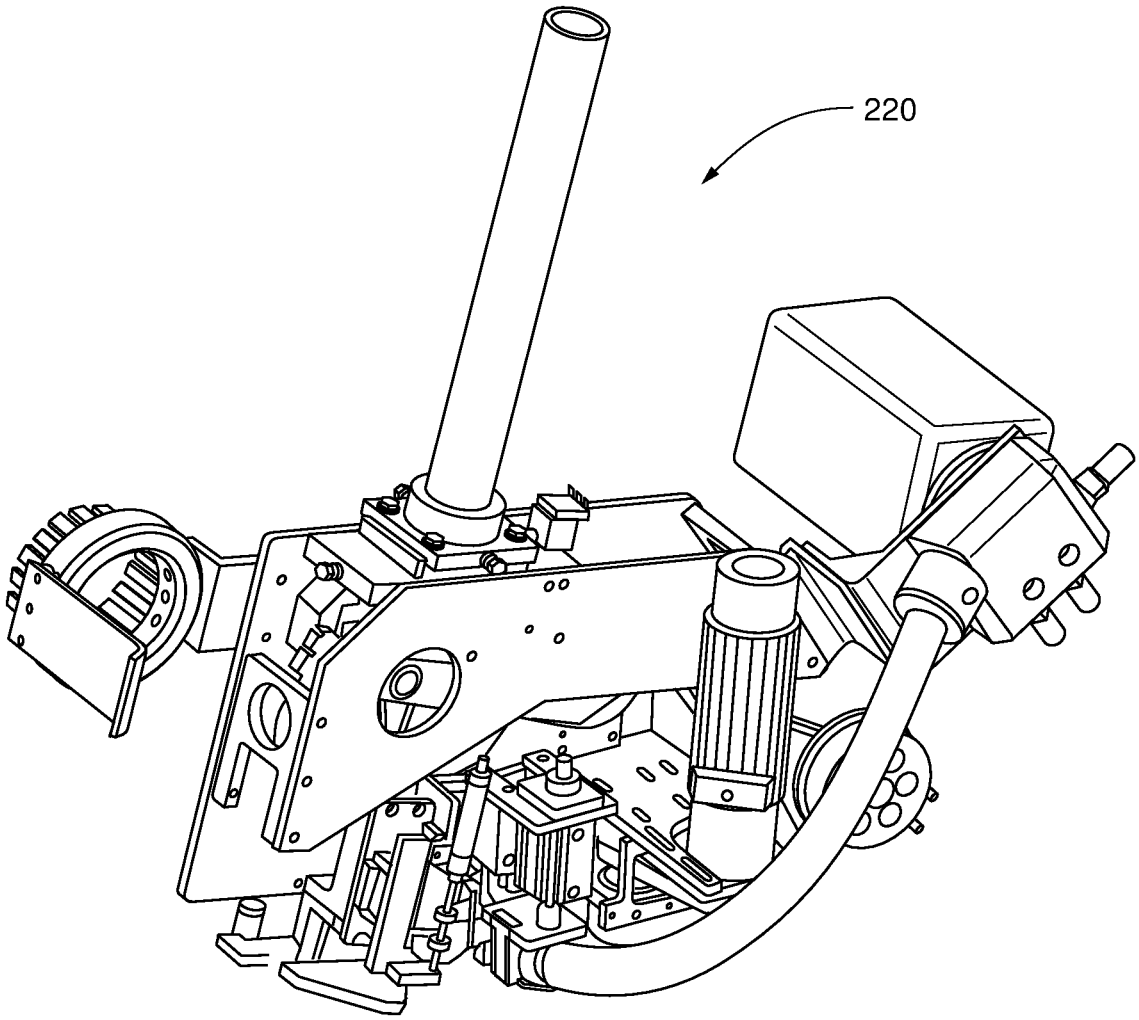
FIG. 19 is a perspective view of a spacer applicator head according to an example embodiment of the invention.

Referring now to FIG. 19, spacer applicator head 220 is depicted in isolation. Features of spacer applicator head 220 are known to those skilled in the art and need not be further described here.

Figure 20:
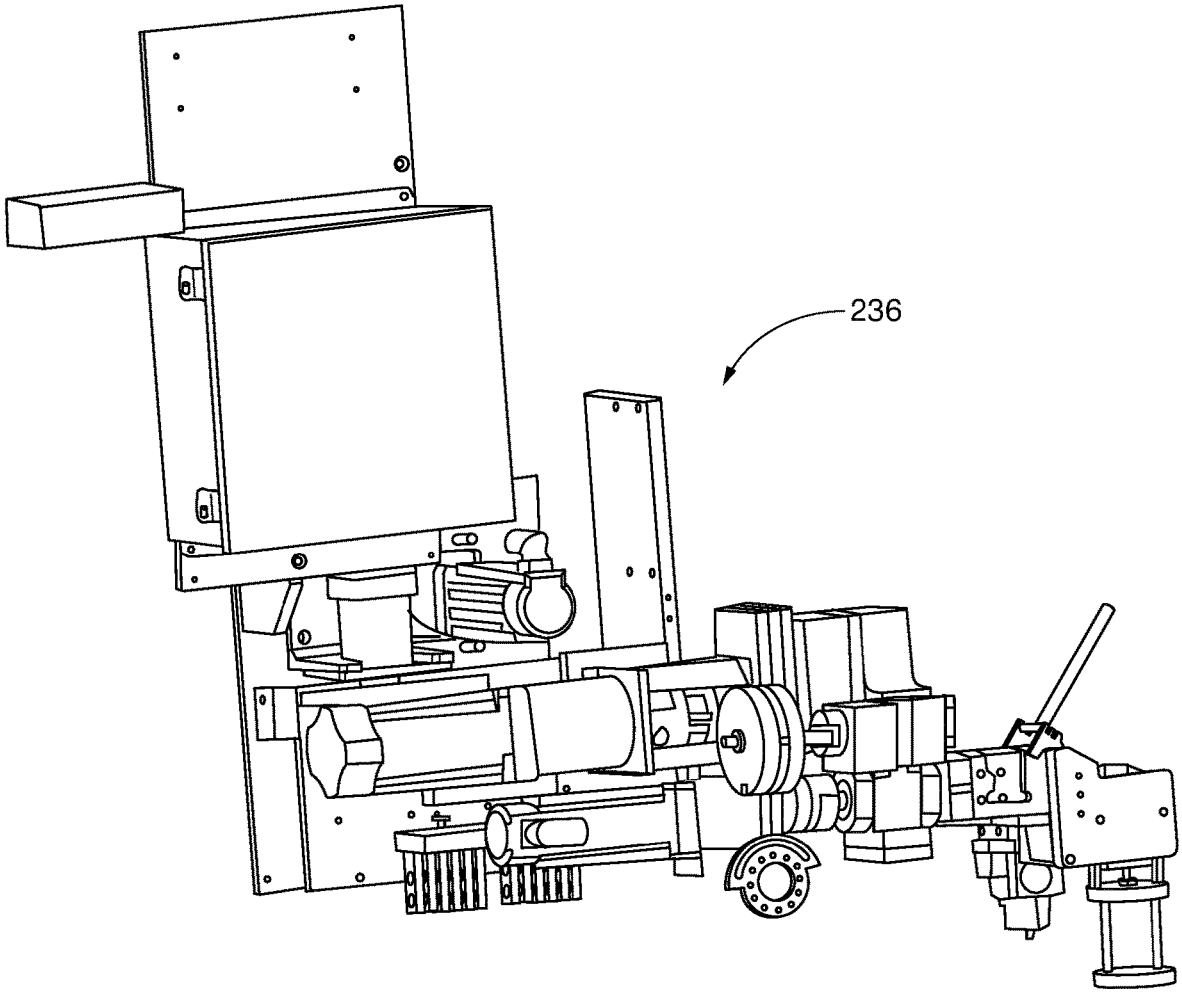
FIG. 20 is a perspective view of a secondary sealant applicator head according to an example embodiment of the invention.

Referring now to FIG. 20 secondary sealant applicator head 236 in isolation. Features of secondary sealant applicator head 236 are known to those skilled in the art need not be further described here.

In operation, referring to FIGS. 2, 6, 7 8 and 6-18, glass lites 150 are transferred from lite storage racks 142 to vertical conveyor 138 by first automated lite picker 122 and second automated lite picker 124 or by robotic lite picker 242. The use of first automated lite picker 122 and second automated lite picker 124 accommodates the use of lites 150 that are coated on one side. Lites 150 with a coating on the side facing first automated lite picker 122 are placed in one lite storage rack 142 while lites 150 with a coating on the side facing away from second automated lite picker 124 are provided in second lite storage rack 142.

Extension arm slide 164 extends outwardly from extension arm track 162 until glass gripper 166 makes contact with lites 150. Glass gripper 166 is activated to grip lite 150. Extension arm slide 164 then retracts into extension arm track 162 and lite 150 is released on vertical conveyor 168. Lites 150 are then conveyed through washer station 104 where they are cleaned.

After cleaning, lites 150 are conveyed to vertical gas filling and wetting station 128 where robot 130 or 238 engages lite 150 with glass gripper head 200. Robot 130 4 to 38 then lifts lites 150 into a position parallel to spacer application station 108.

Spacer applicator head 220 applies spacer around the perimeter of lites 150. It is notable that spacer applicator head 220 applies spacer on the back side of lites 150, that is, the side of lites 150 facing the insulated glass assembly line 120. This is contrary to known prior art.

While spacer is being applied to lite 150, a further lite 150 passes through washer station 104 into position at topping and gas filling station 112. Robot 130 or 238 then places lite 150, fitted with the spacer, against lite 150 that is at topping and gas filling station 112 and presses the two lites 150 together to create a primary seal.

The insulated glass unit thus formed is then lifted from topping and gas filling station 112 and brought into alignment with secondary sealant station 116 so that secondary sealant applicator 206 can apply secondary sealant to the peripheral edges of the insulated glass unit. When the insulated glass unit is complete, robot 130 places the insulated glass unit onto one of IGU storage racks 134.

Referring to FIG. 3, operation of this alternative embodiment is similar to the embodiment depicted in FIG. 2 until the insulated glass unit is assembled with the primary seal. In this alternative embodiment, the first robot 130 returns the insulated glass unit to topping and gas filling station 112. The insulated glass unit is then conveyed to following station 240 where second robot 238 lifts the insulated glass unit and presents the insulated glass unit to secondary sealant applicator head 236 for application of the secondary seal. After secondary sealant applicator head 236 applies the secondary sealant to the insulated glass unit, second robot 238 places the completed insulated glass unit on IGU storage racks 134. The manufacturing cycle then repeats. Of course, earlier stations of insulated glass assembly line 120 may be in operation when materials are passed to later stations so that insulated glass units may be manufactured continuously.

Referring to FIG. 4, in the depicted embodiment lites 150 are removed from lite storage racks 142 by robotic lite picker 242. Lites 150 are then transferred by robotic lite picker 242 to robotic vertical conveyor 244. In doing so, roller beams 252 associated with glass gripper head 250 are aligned to be coplanar with roller beams portion 254 of robotic vertical conveyor 244. Glass gripper head 250 releases lite 150, and lite 150 is conveyed into and through lite washer 126 where lite 150 is cleaned.

Lites 150 are then conveyed out of lite washer 126 to vertical gas filling and wetting station 128. A first lite 150 is then lifted from the vertical gas filling and wetting station 128 by first robot 130. First robot 130 then positions lite 150 in alignment with the applicator station 132 where spacer applicator 204 applies spacer material to four edges of lite 150. Meanwhile a second lite 150 has been picked and sent through lite washer 126 to vertical gas filling and wetting station 128. After spacer material is applied to first lite 150 supported by the first robot 130, first robot 130 then brings first lite 150, including spacer material that has been applied, into contact with second lite 150 that is positioned at vertical gas filling and wetting station 128. Gas filling is accomplished prior to the complete mating of first lite 150 and second lite 150. Once the gas filling is completed at vertical gas filling and wetting station 128, first robot 130 presses the two lites 150 together with spacer material in between. First robot 130 then releases primary sealed insulated glass unit, which is then conveyed from vertical gas filling and wetting station 128 to secondary sealing station 258 in the vicinity of second robot 238. Optionally, the primary sealed insulated glass unit may pass through roll press 266 which then presses the insulated glass unit which has been primary sealed to assure good contact between the applied spacer and lites 150.

The insulated glass unit is then received by secondary sealing station 258, roller beams 252 of second robot 238 and roller beams portion 254 of secondary sealing station 258. While the insulated glass unit is conveyed, roller beams 252 adjacent to glass gripper head 250 are positioned coplanar with roller beams portion 254 of secondary sealing station 258. Once the insulated glass unit is in position, glass gripper head 250 of second robot 238 is actuated to grip the lite 150 of the insulated glass unit. Second robot 238 then lifts the insulated glass unit and positions it in alignment with secondary sealant applicator 206.

Secondary sealant applicator head 236 then travels about the perimeter of the insulated glass unit to apply secondary sealant to the peripheral edges of the IGU. Once the secondary sealant is completely applied, second robot 238 transfers the completed insulated glass unit to IGU storage racks 134. Optionally, corking applicator station 270 may be utilized to apply corking material to one or both external surfaces of the insulated glass unit. Corking is utilized to provide a separation between adjacent insulated glass units on IGU storage racks 134 by application of cork spacers or spacers of other material. The manufacturing cycle then repeats. Of course, earlier stations of insulated glass assembly line 120 may be in operation when materials are passed to later stations so that insulated glass units may be manufactured continuously.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

I claim:

1. A manufacturing line for manufacturing insulated glass units, the manufacturing line comprising:

an infeed station including a first gripper assembly that grips a lite on a front surface side thereof for use in a manufacturing process and transports the lite from a storage rack to a conveyor;

a spacer application station, that receives the lite via the conveyor including a spacer applicator and a second gripper assembly that grips the lite on a front surface side and removes the lite from the conveyor in a direction transverse to a direction of travel of the conveyor and separates a back side of the lite from the conveyor by a first distance sufficient so that the spacer applicator can fit between the conveyor and the lite, and wherein the spacer applicator is interposable between the lite and the conveyor and applies a spacer material proximate perimeter edges of the back side of the lite thus creating a spacer applied lite;

a gas filling and wetting station proximate the conveyor that receives a topping lite via the conveyor, at which the second gripper assembly aligns the spacer applied lite with the topping lite and contacts the spacer material to the topping lite; and a secondary sealant application station including a secondary sealant applicator and a third gripper assembly that grips an insulated glass unit, wherein the insulated glass unit comprises the spacer applied lite primarily sealed to the topping lite opposite the spacer material, and wherein the secondary sealant applicator applies a secondary sealant material to the peripheral edges of the insulated glass unit.

2. The manufacturing line of claim 1, wherein the first gripper assembly comprises an articulated robotic arm.

3. The manufacturing line of claim 2, wherein the second gripper assembly and the third gripper assembly each comprise a single articulated robotic arm.

4. The manufacturing line of claim 1, further comprising at least one quality check station.

5. The manufacturing line of claim 1, wherein at least one of the first gripper assembly, the second gripper assembly, and the third gripper assembly includes at least one suction cup configured to grip the lite.

6. The manufacturing line of claim 1, wherein the gas filling and wetting station further includes a gas source and at least one movable door shiftable between a working position and a resting position, wherein when in the working position the at least one movable door is aligned with a first edge of the spacer applied lite and a second edge of the topping lite, and wherein the gas source injects a gas into a space between the spacer applied lite and the topping lite.

7. The manufacturing line of claim 1, further comprising a roll press located between the gas filling and wetting station and the secondary sealant application station.

8. The manufacturing line of claim 1, wherein the spacer applicator is positioned between the conveyor and the second gripper assembly.

9. The manufacturing line of claim 1, wherein the secondary sealant applicator is positioned between the conveyor and the third gripper assembly.

10. A manufacturing line for manufacturing insulated glass units, the manufacturing line comprising:

an infeed station including a gripper assembly that grips a lite on a surface thereof and moves the lite on and off a conveyor;

a work station including a spacer applicator and a secondary sealant applicator, wherein the gripper assembly removes the lite from the conveyor in a direction transverse to a direction of travel of the conveyor and separates a back surface of the lite from the conveyor by a first distance, and wherein the first distance is sufficient so that the spacer applicator and the secondary sealant applicator are interposable between the lite and the conveyor and the spacer applicator applies a spacer material proximate perimeter edges of the back side thus creating a spacer applied lite, the gripper assembly aligning the spacer applied lite across the spacer material from a topping lite, received via the conveyor, and contacting the spacer material to the topping lite, thus creating an insulated glass unit, wherein the secondary sealant applicator is interposable between the insulated glass unit and the conveyor and applies a secondary sealant material to the peripheral edges of the insulated glass unit.

11. The manufacturing line of claim 10, wherein the gripper assembly comprises an articulated robotic arm.

12. The manufacturing line of claim 10, wherein at least one of a primary sealant applicator and the secondary sealant applicator is positioned between the conveyor and the gripper assembly.

13. A method of manufacturing insulated glass units, the method comprising:

providing a gripper assembly configured to move a lite or an insulated glass unit between a conveyor of a manufacturing line and a work station;

placing the lite on the conveyor at an infeed station;

conveying the lite from the infeed station to the work station, the work station including a spacer applicator interposable between the gripper assembly and the conveyor and a secondary sealant applicator interposable between the gripper assembly and the conveyor;

gripping a front side of the lite and removing the lite from the conveyor, in a direction transverse to a direction of travel of the conveyor such that a back side of the lite is separated from the conveyor by a distance sufficient to enable the spacer applicator and the secondary sealant applicator to be interposed between the lite and the conveyor;

applying a spacer material proximate perimeter edges of the back side of the lite via the spacer applicator, thus creating a spacer applied lite;

aligning the spacer applied lite with a topping lite on the conveyor, wherein the spacer material is between the spacer applied lite and the topping lite;

adhering the spacer material of the spacer applied lite with the topping lite, thus forming the insulated glass unit; and applying a secondary sealant material to the peripheral edges of the insulated glass unit via the secondary sealant applicator.

14. The method of claim 13, further including performing at least one quality check.

15. The method of claim 13, further including washing the lite as the lite is conveyed from the infeed station to the work station.

16. The method of claim 13, further comprising pressing the insulated glass unit before applying the secondary sealant.

17. The method of claim 13, wherein the gripper assembly comprises an articulated robotic arm having a gripper head.

18. The method of claim 17, wherein the gripper head adjusts between an extended position and a retracted position based on the size of the lite used to manufacture the insulated glass unit.

19. The method of claim 13, wherein the gripper assembly uses a vacuum seal to grip the lite or the insulated glass unit.

20. The method of claim 13, further comprising filling the space between the spacer applied lite and the topping lite with a gas before adhering the spacer applied lite with the topping lite.

* * * * *